US006548237B2

(12) United States Patent
Mikoshiba et al.

(10) Patent No.: US 6,548,237 B2
(45) Date of Patent: Apr. 15, 2003

(54) SILVER HALIDE COLOR PHOTOGRAPHIC LIGHTSENSITIVE MATERIAL AND METHOD OF FORMING COLOR IMAGE USING THE SAME

(75) Inventors: Hisashi Mikoshiba, Minami-Ashigara (JP); Hiroshi Fukuzawa, Minami-Ashigara (JP); Naoto Matsuda, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/897,067

(22) Filed: Jul. 3, 2001

(65) Prior Publication Data

US 2002/0039709 A1 Apr. 4, 2002

(30) Foreign Application Priority Data

Jul. 4, 2000 (JP) ..... 2000-202488

(51) Int. Cl.[7] ..... G03C 1/46

(52) U.S. Cl. ..... 430/551; 430/558

(58) Field of Search ..... 430/551, 558

(56) References Cited

U.S. PATENT DOCUMENTS 5,972,587 A * 10/1999 Romanet et al. ..... 430/543
6,159,671 A 1/2000 Matsuda ..... 430/505

* cited by examiner

*Primary Examiner*—Hoa Van Le
(74) *Attorney, Agent, or Firm*—Birch, Stewart, Kolasch & Birch, LLP

(57) ABSTRACT

A silver halide color photographic lightsensitive material comprises a support and a silver halide emulsion layer. The lightsensitive material contains a magenta coupler of Formula (MC-I):

(MC-I)

{$R^{31}$ and $R^{32}$ includes a hydrogen atom, alkyl and aryl groups}, and at least one compound selected from Formulae (TS-I) to (TS-III):

(TS-I-α)

(TS-II)

(TS-III)

{$R^{1a}$ and $R^{2a}$ includes a hydrogen atom, alkyl and aryl groups, —$X^{1a}$— and —$X^{2a}$— includes —O— and —N($R^{24}$)— ($R^{24}$ includes an alkyl group), and $R^2$ $R^3$, $R^5$, and $R^6$ include hydrogen and halogen atoms, alkyl, alkoxy and acylamino groups, $R^{11}$ to $R^{14}$ include alkyl and alkenyl groups, $X_2$ includes alkoxy group and $X^3$ includes a group of nonmetallic atoms required to form a 5–7 membered ring, $R^{21}$ includes a hydrogen atom, $R^{22}$ includes alkyl and aryl groups, $X^4$ includes —CO—$R^{123}$, —CO—O—$R^{123}$ and —CO—N$R^{124}$ ($R^{125}$) ($R^{123}$ includes alkyl and aryl groups, $R^{124}$ and $R^{125}$ include a hydrogen atom, alkyl and aryl groups)}.

15 Claims, No Drawings

SILVER HALIDE COLOR PHOTOGRAPHIC LIGHTSENSITIVE MATERIAL AND METHOD OF FORMING COLOR IMAGE USING THE SAME

CROSS-REFERENCE TO RELATED APPLICATION

This application is based upon and claims the benefit of priority from the prior Japanese Patent Application No. 2000-202488, filed Jul. 4, 2000, the entire contents of which are incorporated herein by reference.

BACKGROUND OF THE INVENTION

The present invention relates to a novel color coupler compound and further to a silver halide color photographic lightsensitive material containing the same and a method of forming an image with the use thereof. More particularly, the present invention relates to a silver halide color reversal photographic lightsensitive material and a method of forming an image with the use thereof.

In recent years, there is a strong demand for a silver halide color lightsensitive material exhibiting not only high sensitivity, high sharpness and excellent graininess but also enhanced color reproduction.

In the field of silver halide color photographic lightsensitive materials, although 1-phenyl-5-pyrazolone couplers have widely been employed as magenta couplers, pyrazolotriazole magenta couplers which form a dye of hue with less secondary absorption, preferred as an image forming dye, have also become widely employed.

Although pyrazolotriazole magenta couplers are attractive compounds in their characteristics of exhibiting desirable hue, those wherein the position for coupling with an aromatic primary amine developing agent in an oxidized form is a hydrogen atom, generally known as four-equivalent couplers, have a drawback in that yellow coloring would occur with the passage of time after the development thereof.

On the other hand, two-equivalent couplers wherein the coupling position is substituted with a coupling split-off group other than a hydrogen atom (e.g., a halogen atom) have the characteristic of exhibiting less tendency toward yellow coloring as compared with that of the four-equivalent couplers.

With respect to a color reversal photographic lightsensitive material, the first development is followed by the reversal processing and the color development in this sequence. The use of two-equivalent couplers in the color reversal photographic lightsensitive material invites an intrinsic problem of sensitivity decrease as compared with the use of four-equivalent couplers because the color forming capability per mol of silver is high in the use of two-equivalent couplers. Therefore, when the pyrazolotriazole magenta couplers are applied to the color reversal photographic lightsensitive material, it is preferred to employ the four-equivalent couplers from the viewpoint of sensitivity. The application of four-equivalent pyrazolotriazole magenta couplers to a color reversal photographic lightsensitive material is disclosed in, for example, Jpn. Pat. Appln. KOKAI Publication Nos. (hereinafter referred to as JP-A's) 5-100382 and 63-153548. However, the above-mentioned problem of yellow coloring with the passage of time after the processing has not yet been solved. In particular, it has been a problem that an increase of yellow stain is caused when a sample having been allowed to stand still for a prolonged period of time after the processing is irradiated with light. With respect to this stain, an improvement can be effected by changing a partial structure of coupler, but it has been unsatisfactory.

BRIEF SUMMARY OF THE INVENTION

It is an object of the present invention to provide a silver halide color photographic lightsensitive material which is excellent in color reproduction and in image fastness (fastness to light and fastness to dark heat) and which minimizes staining.

It is another object of the present invention to provide a color reversal photographic lightsensitive material which is excellent in the storagebility of lightsensitive material and is highly resistant to development processing composition variations. It is a further object of the present invention to effect an improvement in the yellow stain occurring when a sample having been allowed to stand still for a prolonged period of time after the processing is irradiated with light.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The inventors have conducted extensive and intensive studies with respect to additives used in combination with four-equivalent pyrazolotriazole couplers. As a result, it has been found that a compound of specified structure suppresses staining and, in particular, effectively suppresses the stain occurring when a sample having been allowed to stand still for a prolonged period of time after the processing is irradiated with light. It has further been found that the fastness of color image can also been enhanced thereby. The present invention has been completed on the basis of these findings.

The above objects of the present invention have been attained by the following means.

(1) A silver halide color photographic lightsensitive material comprising, on a support, at least one silver halide emulsion layer, wherein the silver halide color photographic lightsensitive material contains at least magenta coupler represented by a general formula (MC-I):

(MC-I)

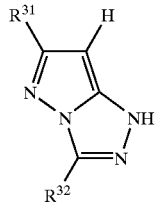

wherein, each of $R^{31}$ and $R^{32}$ independently represents a hydrogen atom, a substituted or unsubstituted alkyl group, or a substituted or unsubstituted aryl group; and at least one compound selected from a group consisting of compounds represented by a general formula (TS-I), compounds represented by a general formula (TS-II) and compounds represented by a general formula (TS-III):

(TS-I)

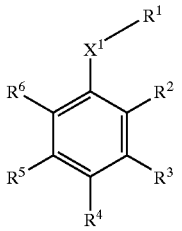

(TS-II)

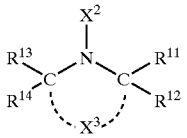

(TS-III)

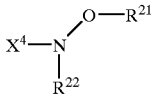

wherein in the formula (TS-I), $R^1$ represents any of a hydrogen atom, a substituted or unsubstituted alkyl group (including a cycloalkyl group and a bicycloalkyl group), a substituted or unsubstituted alkenyl group (including a cycloalkenyl group and a bicycloalkenyl group), a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group (including a cycloalkylsulfonyl group and a bicycloalkylsulfonyl group), a substituted or unsubstituted arylsulfonyl group, a substituted or unsubstituted phosphino group, a substituted or unsubstituted phosphinyl group and a group of the formula $—SiR^{21}R^{22}R^{23}$ wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; $—X^1—$ represents —O—, —S— or $—N(R^{24})—$ wherein $R^{24}$ has the same meaning as $R^1$; and $R^2$, $R^3$, $R^4$, $R^5$ and $R^6$ may be identical with or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5 to 7 membered ring, provided that $R^2$ and $R^3$, or $R^3$ and $R^4$, or $R^4$ and $R^5$, or $R^5$ and $R^6$, may be bonded with each other to thereby form a 5 to 7 membered ring, Spiro ring or bicyclo ring, and provided that $R^1$, $R^2$, $R^3$, $R^4$, $R^5$, $R^6$ and $R^{24}$ are not simultaneously hydrogen atoms;

in the formula (TS-II), each of $R^{11}$, $R^{12}$, $R^{13}$ and $R^{14}$ independently represents any of a hydrogen atom, a substituted or unsubstituted alkyl group (including a cycloalkyl group and a bicycloalkyl group) and a substituted or unsubstituted alkenyl group (including a cycloalkenyl group and a bicycloalkenyl group), provided that $R^{11}$ and $R^{12}$ or $R^{13}$ and $R^{14}$ may be bonded with each other to thereby form a 5 to 7 membered ring; $X^2$ represents any of a hydrogen atom, a substituted or unsubstituted alkyl group (including a cycloalkyl group and a bicycloalkyl group), a substituted or unsubstituted alkenyl group (including a cycloalkenyl group and a bicycloalkenyl group), a substituted or unsubstituted alkoxy group (including a cycloalkyloxy group), substituted or unsubstituted alkenyloxy group, alkyl- and alkenyloxycarbonyl groups, a substituted or unsubstituted aryloxycarbonyl group, acyl groups, a substituted or unsubstituted acyloxy group, a substituted or unsubstituted alkyloxycarbonyloxy group, a substituted or unsubstituted alkenyloxycarbonyloxy group, substituted or unsubstituted aryloxycarbonyloxy group, alkyl- and alkenylsulfonyl groups, substituted or unsubstituted arylsulfonyl group, alkyl- and alkenylsulfinyl groups, a substituted or unsubstituted arylsulfinyl group, a substituted or unsubstituted sulfamoyl group, a substituted or unsubstituted carbamoyl group, a hydroxyl group and an oxyl group; and $X^3$ represents a group of nonmetallic atoms required for forming a 5 to 7 membered ring; and in the formula (TS-III), each of $R^{21}$ and $R^{22}$ independently has the same meaning as $R^1$; $X^4$ represents a substituted or unsubstituted alkyl group or a substituted or unsubstituted aryl group, a substituted or unsubstituted heterocyclic group, $—CO—R^{123}$, $—CO—O—R^{123}$ or $—CO—NR^{124}(R^{125})$ wherein $R^{123}$ represents a substituted or unsubstituted alkyl group, a substituted or unsubstituted aryl group or a substituted or unsubstituted heterocyclic group, and each of $R^{124}$ and $R^{125}$ independently represents a hydrogen atom, a substituted or unsubstituted alkyl group, a substituted or unsubstituted aryl group, a substituted or unsubstituted amino group, or a substituted or unsubstituted alkoxy group.

(2) A method of forming a color image, comprising sequentially subjecting the silver halide color photographic lightsensitive material as defined in item (1) above to black and white development, reversal processing and color development using a color developer of 11.5 or higher pH value, wherein the color developer is replenished in a quantity of less than 1.6 L per $m^2$ of the lightsensitive material.

(3) A method of reducing stain caused by light irradiation after the elapse of a prolonged period of time after processing in a silver halide color photographic lightsensitive material containing a magenta coupler represented by a general formula (MC-I):

(MC-I)

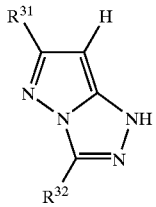

wherein $R^{31}$ and $R^{32}$ have the same meanings as those defined in the formula (MC-I) of the item (1) above, respectively; wherein the method comprises loading the silver halide color photographic lightsensitive material with at least one compound selected from a group consisting of compounds represented by the general formula (TS-I), the general formula (TS-II) and general formula (TS-III):

(TS-I)

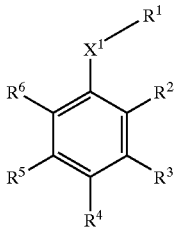

(TS-II)

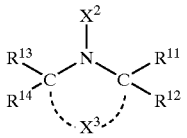

(TS-III)

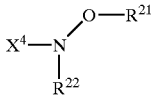

wherein $R^1$, $R^2$, $R^3$, $R^4$, $R^5$, $R^6$ and —$X^1$— have the same meanings as those defined in the general formula (TS-I) of the item (1) above, respectively;

$R^{11}$, $R^{12}$, $R^{13}$, $R^{14}$, $X^2$ and $X^3$ have the same meanings as those defined in the general formula (TS-II) of the item (1) above, respectively; and $R^{21}$, $R^{22}$ and $X^4$ have the same meanings as those defined in the general formula (TS-III) of the item (1) above, respectively.

(4) A silver halide color photographic lightsensitive material comprising a layer simultaneously loaded with a magenta coupler represented by the following general formula (MC-I) and a compound represented by the following general formula (TS-III):

(MC-I)

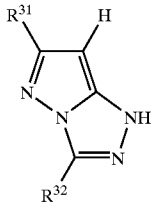

(TS-III)

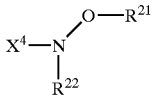

wherein, $R^{31}$ and $R^{32}$ have the same meanings as those of the general formula (MC-I) of the item (1) above, respectively, and in $R^{21}$, $R^{22}$ and $X^4$ have the same meanings as those of the general formula (TS-III) of the item (1) above, respectively.

The present invention will be described in detail below.

In the general formula (MC-I), each of $R^{31}$ and $R^{32}$ independently represents a hydrogen atom, a substituted or unsubstituted alkyl group, or a substituted or unsubstituted aryl group.

When each of $R^{31}$ and $R^{32}$ is a substituted alkyl or aryl group, the substituent that attaches to each of $R^{31}$ and $R^{32}$ can be, for example, any of a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, alkyl- and arylsulfonylamino groups, a mercapto group, an alkylthio group, an arylthio group, a heterocyclic thio group, a sulfamoyl group, a sulfo group, alkyl- and arylsulfinyl groups, alkyl- and arylsulfonyl groups, an acyl group, an aryloxycarbonyl group, an alkoxycarbonyl group, a carbamoyl group, aryl and heterocyclic azo groups, an imido group, a phosphino group, a phosphinyl group, a phosphinyloxy group, a phosphinylamino group and a silyl group.

More specifically, the substituent of the substituted $R^{31}$ and $R^{32}$ can be a halogen atom (e.g., a chlorine atom, bromine atom, and iodine atom), and an alkyl group [which represents a straight-chain, branched, or cyclic, substituted or unsubstituted alkyl group. Examples are an alkyl group (preferably a substituted or unsubstituted alkyl group having 1 to 30 carbon atoms, e.g., methyl, ethyl, n-propyl, isopropyl, t-butyl, n-octyl, eicosyl, 2-chloroethyl, 2-cyanoethyl, and 2-ethylhexyl), a cycloalkyl group (preferably a substituted or unsubstituted cycloalkyl group having 3 to 30 carbon atoms, e.g., cyclohexyl, cyclopentyl, and 4-n-dodecylcyclohexyl), a bicycloalkyl group (preferably a substituted or unsubstituted bicycloalkyl group having 5 to 30 carbon atoms, i.e., a monovalent group obtained by removing one hydrogen atom from a bicycloalkane having 5 to 30 carbon atoms. Examples are bicyclo[1,2,2]heptane-2-yl and bicyclo[2,2,2]octane-3-yl). Also an alkyl group having more cyclic structure such as a tricyclic alkyl group is included. The alkyl group to be described below, such as the alkyl group of an alkylthio group, also includes the concept of the alkyl group mentioned above.]

The substituent of the substituted $R^{31}$ and $R^{32}$ can also be alkenyl group [which represents a straight-chain, branched, or cyclic, substituted or unsubstituted alkenyl group. Examples are an alkenyl group (preferably a substituted or unsubstituted alkenyl group having 2 to 30 carbon atoms, e.g., vinyl, allyl, prenyl, geranyl, and oleyl), cycloalkenyl group (preferably a substituted or unsubstituted cycloalkenyl group having 3 to 30 carbon atoms, i.e., a monovalent group obtained by removing one hydrogen atom from a cycloalkene having 3 to 30 carbon atoms. Examples are 2-cyclopentene-1-yl and 2-cyclohexene-1-yl), bicycloalkenyl group (a substituted or unsubstituted bicycloalkenyl group, preferably a substituted or unsubstituted bicycloalkenyl group having 5 to 30 carbon atoms, i.e., a monovalent group obtained by removing one hydrogen atom from bicycloalkene having one double bond. Examples are bicyclo[2,2,1]hept-2-ene-1-yl and bicyclo[2,2,2]oct-2-ene-4-yl)].

The substituent of the substituted $R^{31}$ and $R^{32}$ can also be an alkynyl group (preferably a substituted or unsubstituted alkynyl group having 2 to 30 carbon atoms, e.g., ethynyl, propargyl, and trimethylsilylethynyl), an aryl group (preferably a substituted or unsubstituted aryl group having 6 to 30 carbon atoms, e.g., phenyl, p-tolyl, naphthyl, m-chlorophenyl, and o-hexadecanoylaminophenyl), heterocyclic group (preferably a monovalent group obtained by removing one hydrogen atom from a 5- or 6-membered, substituted or unsubstituted, aromatic or nonaromatic heterocyclic compound, and more preferably, a 5- or 6-membered aromatic heterocyclic group having 3 to 30 carbon atoms. Examples are 2-furyl, 2-thienyl, 2-pyrimidinyl, and 2-benzothiazolyl), cyano group, hydroxyl group, nitro group, carboxyl group, and alkoxy group (preferably a substituted or unsubstituted alkoxy group having 1 to 30 carbon atoms, e.g., methoxy, ethoxy, isopropoxy, t-butoxy, n-octyloxy, and 2-methoxyethoxy).

The substituent of the substituted $R^{31}$ and $R^{32}$ can also be an aryloxy group (preferably a substituted or unsubstituted aryloxy group having 6 to 30 carbon atoms, e.g., phenoxy, 2-methylphenoxy, 4-t-butylphenoxy, 3-nitrophenoxy, and 2-tetradecanoylaminophenoxy), silyloxy group (preferably a silyloxy group having 3 to 20 carbon atoms, e.g., trimethylsilyloxy and t-butyldimethylsilyloxy), heterocyclic oxy group (preferably a substituted or unsubstituted heterocyclic oxy group having 2 to 30 carbon atoms, e.g., 1-phenyltetrazole-5-oxy and 2-tetrahydropyranyloxy), and acyloxy group (preferably a formyloxy group, a substituted or unsubstituted alkylcarbonyloxy group having 2 to 30 carbon atoms, and a substituted or unsubstituted arylcarbonyloxy group having 7 to 30 carbon atoms, e.g., formyloxy, acetyloxy, pivaloyloxy, stearoyloxy, benzoyloxy, and p-methoxyphenylcarbonyloxy).

The substituent of the substituted $R^{31}$ and $R^{32}$ can also be a carbamoyloxy group (preferably a substituted or unsubstituted carbamoyloxy group having 1 to 30 carbon atoms, e.g., N,N-dimethylcarbamoyloxy, N,N-diethylcarbamoyloxy, morpholinocarbonyloxy, N,N-di-n-octylaminocarbonyloxy, and N-n-octylcarbamoyloxy), alkoxycarbonyloxy group (preferably a substituted or unsubstituted alkoxycarbonyloxy group having 2 to 30 carbon atoms, e.g., methoxycarbonyloxy, ethoxycarbonyloxy, t-butoxycarbonyloxy, and n-octylcarbonyloxy), and aryloxycarbonyloxy group (preferably a substituted or unsubstituted aryloxycarbonyloxy group having 7 to 30 carbon atoms, e.g., phenoxycarbonyloxy, p-methoxyphenoxycarbonyloxy, and p-(n-hexadecyloxy) phenoxycarbonyloxy).

The substituent of the substituted $R^{31}$ and $R^{32}$ can also be an amino group (including an anilino group) (preferably an unsubstituted amino group, a substituted or unsubstituted alkylamino group having 1 to 30 carbon atoms, and a substituted or unsubstituted anilino group having 6 to 30 carbon atoms, e.g., methylamino, dimethylamino, anilino, N-methyl-anilino, and diphenylamino), acylamino group (preferably a formylamino group, a substituted or unsubstituted alkylcarbonylamino group having 2 to 30 carbon atoms, and a substituted or unsubstituted arylcarbonylamino group having 7 to 30 carbon atoms, e.g., acetylamino, pivaloylamino, lauroylamino, benzoylamino, and 3,4,5-tri-(n-octyloxyphenyl)carbonylamino), and aminocarbonylamino group (preferably a substituted or unsubstituted aminocarbonylamino having 1 to 30 carbon atoms, e.g., carbamoylamino, N,N-dimethylaminocarbonylamino, N,N-diethylaminocarbonylamino, and morpholinocarbonylamino).

The substituent of the substituted $R^{31}$ and $R^{32}$ can also be an alkoxycarbonylamino group (preferably a substituted or unsubstituted alkoxycarbonylamino group having 2 to 30 carbon atoms, e.g., methoxycarbonylamino, ethoxycarbonylamino, t-butoxycarbonylamino, n-octadecyloxycarbonylamino, and N-methylmethoxycarbonylamino), aryloxycarbonylamino group (preferably a substituted or unsubstituted aryloxycarbonylamino group having 7 to 30 carbon atoms, e.g., phenoxycarbonylamino, p-chlorophenoxycarbonylamino, and m-(n-octyloxy)phenoxycarbonylamino), sulfamoylamino group (preferably a substituted or unsubstituted sulfamoylamino group having 0 to 30 carbon atoms, e.g., sulfamoylamino, N,N-dimethylaminosulfonylamino, and N-n-octylaminosulfonylamino).

The substituent of the substituted $R^{31}$ and $R^{32}$ can also be an alkylsulfonylamino and arylsulfonylamino groups (preferably a substituted or unsubstituted alkylsulfonylamino having 1 to 30 carbon atoms, and a substituted or unsubstituted arylsulfonylamino having 6 to 30 carbon atoms, e.g., methylsulfonylamino, butylsulfonylamino, phenylsulfonylamino, 2,3,5-trichlorophenylsulfonylamino, and p-methylphenylsulfonylamino), mercapto group, alkylthio group (preferably a substituted or unsubstituted alkylthio group having 1 to 30 carbon atoms, e.g., methylthio, ethylthio, and n-hexadecylthio), arylthio group (preferably a substituted or unsubstituted arylthio group having 6 to 30 carbon atoms, e.g., phenylthio, p-chlorophenylthio, and m-methoxyphenylthio), and heterocyclic thio group (preferably a substituted or unsubstituted heterocyclic thio group having 2 to 30 carbon atoms, to which an aromatic ring such as a benzene ring may be condenced, e.g., 2-benzothiazolylthio and 1-phenyl-tetrazole-5-ylthio).

The substituent of the substituted $R^{31}$ and $R^{32}$ can also be a sulfamoyl group (preferably a substituted or unsubstituted sulfamoyl group having 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), sulfo group, alkylsulfinyl and arylsulfinyl groups (preferably a substituted or unsubstituted alkylsulfinyl group having 1 to 30 carbon atoms, and a substituted or unsubstituted arylsulfinyl group having 6 to 30 carbon atoms, e.g., methylsulfinyl, ethylsulfinyl, phenylsulfinyl, and p-methylphenylsulfinyl).

The substituent of the substituted $R^{31}$ and $R^{32}$ can also be an alkylsulfonyl and arylsulfonyl groups (preferably a substituted or unsubstituted alkylsulfonyl group having 1 to 30 carbon atoms, and a substituted or unsubstituted arylsulfonyl group having 6 to 30 carbon atoms, e.g., methylsulfonyl, ethylsulfonyl, phenylsulfonyl, and p-methylphenylsulfonyl), acyl group (preferably a formyl group substituted or unsubstituted alkylcarbonyl group having 2 to 30 carbon atoms, a substituted or unsubstituted arylcarbonyl group having 7 to 30 carbon atoms, and a substituted or unsubstituted heterocycliccarbonyl group, whose carbon atom in the heterocyclic ring bonds to the carbonyl group thereof, e.g., acetyl, pivaloyl, 2-chloroacetyl, stearoyl, benzoyl, p-(n-octyloxy)phenylcarbonyl, 2-pyridylcarbonyl and 2-furylcarbonyl), aryloxycarbonyl group (preferably a substituted or unsubstituted aryloxycarbonyl group having 7 to 30 carbon atoms, e.g., phenoxycarbonyl, o-chlorophenoxycarbonyl, m-nitrophenoxycarbonyl, and p-(t-butyl)phenoxycarbonyl), and an alkoxycarbonyl group (e.g., a substituted or unsubstituted alkoxycarbonyl group having 2 to 30 carbon atoms, e.g., methoxycarbonyl, ethoxycarbonyl, t-butoxycarbonyl, and n-octadecyloxycarbonyl).

The substituent of the substituted $R^{31}$ and $R^{32}$ can also be a carbamoyl group (preferably a substituted or unsubstituted carbamoyl having 1 to 30 carbon atoms, e.g., carbamoyl, N-methylcarbamoyl, N,N-dimethylcarbamoyl, N,N-di-(n-octyl)carbamoyl, and N-(methylsulfonyl)carbamoyl), arylazo and heterocyclic azo groups (preferably a substituted or unsubstituted arylazo group having 6 to 30 carbon atoms, and a substituted or unsubstituted heterocyclic azo group having 3 to 30 carbon atoms, e.g., phenylazo, p-chlorophenylazo, and 5-ethylthio-1,3,4-thiadiazole-2-ylazo), imide group (preferably N-succinimide and N-phthalimide), phosphino group (preferably a substituted or unsubstituted phosphino group having 2 to 30 carbon atoms, e.g., dimethylphosphino, diphenylphosphino, and methylphenoxyphosphino), and phosphinyl group (preferably a substituted or unsubstituted phosphinyl group having 0 to 30 carbon atoms, e.g., phosphinyl, dioctyloxyphosphinyl, and diethoxyphosphinyl).

The substituent of the substituted $R^{31}$ and $R^{32}$ can also be a phosphinyloxy group (preferably a substituted or unsubstituted phosphinyloxy group having 2 to 30 carbon atoms, e.g., diphenoxyphosphinyloxy and dioctyloxyphosphinyloxy), phosphinylamino group (preferably a substituted or unsubstituted phosphinylamino group having 2 to 30 carbon atoms, e.g., dimethoxyphosphinylamino and dimethylaminophosphinylamino), and silyl group (preferably a substituted or unsubstituted silyl group having 3 to 30 carbon atoms, e.g., trimethylsilyl, t-butyldimethylsilyl, and phenyldimethylsilyl).

Of the above substituents, those having a hydrogen atom may be further substituted by the above groups by removing the hydrogen atom. Examples of such substituents are an alkylcarbonylaminosulfonyl group, arylcarbonylaminosulfonyl group, alkylsulfonylaminocarbonyl group, and arylsulfonylaminocarbonyl group. Examples of these groups are methylsulfonylaminocarbonyl, p-methylphenylsulfonylaminocarbonyl, acetylaminosulfonyl, and a benzoylaminosulfonyl group.

In the general formula (MC-I), $R^{31}$ preferably represents a substituted or unsubstituted alkyl group having 1 to 30 carbon atoms or a substituted or unsubstituted aryl group having 6 to 20 carbon atoms. More preferably, $R^{31}$ represents a substituted or unsubstituted alkyl group having 1 to 6 carbon atoms. Still more preferably, $R^{31}$ represents an unsubstituted tertiary or secondary alkyl group having 3 to 6 carbon atoms. Yet still more preferably, $R^{31}$ represents an unsubstituted tertiary alkyl group having 4 to 6 carbon atoms. Most preferably, $R^{31}$ represents a t-butyl group.

$R^{32}$ preferably represents a substituted or unsubstituted alkyl group having 1 to 30 carbon atoms or a substituted or unsubstituted aryl group having 6 to 30 carbon atoms. More preferably, $R^{32}$ represents a substituted or unsubstituted alkyl group having 2 to 30 carbon atoms. Still more preferably, $R^{31}$ represents a substituted alkyl group having 2 to 30 carbon atoms.

The substituent introduced in the substituted $R^{32}$ can be any of acylamino groups, alkyl- and arylsulfonylamino groups, alkoxycarbonylamino groups and aminocarbonylamino groups. These may be further substituted with the substituent described as being introduced as the substituent in the substituted $R^{32}$.

Preferred forms of the structures represented by the general formula (MC-I) are those represented by the following general formula (MC-II):

(MC-II)

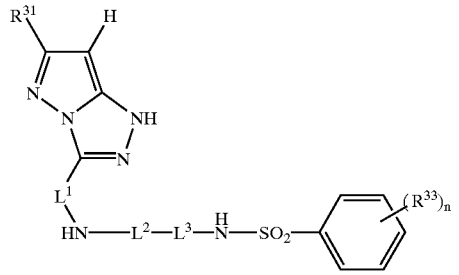

In the general formula (MC-II), $R^{31}$ has the same meaning as the $R^{31}$ of the general formula (MC-I). $L^1$ represents a substituted or unsubstituted alkylene group or a substituted or unsubstituted arylene group. $L^2$ represents —$SO_2$— or —CO—. $L^3$ represents a substituted or unsubstituted alkylene group or a substituted or unsubstituted arylene group. $R^{33}$ has the same meaning as the $R^2$ of the general formula (TS-I) (provided that a hydrogen atom is excluded). n is an integer of 0 to 5. When n is 2 or greater, a plurality of $R^{33}$ groups may be identical with or different from each other.

In the general formula (MC-II), $R^{31}$ represents a hydrogen atom, a substituted or unsubstituted alkyl group, or a substituted or unsubstituted aryl group. $R^{31}$ preferably represents a substituted or unsubstituted alkyl group having 1 to 30 carbon atoms or a substituted or unsubstituted aryl group having 6 to 20 carbon atoms. More preferably, $R^{31}$ represents a substituted or unsubstituted alkyl group having 1 to 6 carbon atoms. Still more preferably, $R^{31}$ represents an unsubstituted tertiary or secondary alkyl group having 3 to 6 carbon atoms. Yet still more preferably, $R^{31}$ represents an unsubstituted tertiary alkyl group having 4 to 6 carbon atoms. Most preferably, $R^{31}$ represents a t-butyl group.

$L^1$ preferably represents a substituted or unsubstituted alkylene group having 1 to 30 carbon atoms or a substituted or unsubstituted arylene group having 6 to 30 carbon atoms. The substituent introduced in the substituted $L^1$ can be, for example, any of groups described as the substituent of the substituted $R^{31}$ and $R^{32}$ of the general formula (MC-I). $L^1$ more preferably represents a substituted or unsubstituted alkylene group having 1 to 30 carbon atoms. The substituent introduced in the substituted alkylene group is preferably an alkoxy group, an aryloxy group or a halogen atom.

Still more preferably, $L^1$ represents an unsubstituted alkylene group having 1 to 10 carbon atoms. Yet still more preferably, L represents an unsubstituted alkylene group having 1 to 3 carbon atoms (methylene, 1,2-ethylene, 1,3-propylene, 1-methylmethylene, 1,1-dimethylmethylene or 2-methyl-1,2-ethylene). Most preferably, $L^1$ represents 1-methylmethylene.

$L^2$ represents —$SO_2$— or —CO—, preferably —$SO_2$—.

$L^3$ represents a substituted or unsubstituted alkylene group or a substituted or unsubstituted arylene group. $L^3$ preferably represents a substituted or unsubstituted alkylene group having 1 to 30 carbon atoms or a substituted or unsubstituted arylene group having 6 to 30 carbon atoms. The substituent introduced in the substituted $L^3$ can be, for example, any of groups described as the substituent in the substituted $R^{31}$ and $R^{32}$ of the general formula (MC-I).

More preferably, $L^3$ represents a substituted or unsubstituted arylene group having 6 to 30 carbon atoms. Still more preferably, $L^3$ represents a substituted or unsubstituted arylene group having 6 to 16 carbon atoms. The substituent introduced in the substituted $L^3$ is preferably an alkoxy group, an aryloxy group, a halogen atom or an alkyl group.

$R^{33}$ has the same meaning as the $R^2$ of the general formula (TS-I). $R^{33}$ is preferably an electron attractive substituent whose Hammett's constant up value is 0 or greater. In particular, $R^{33}$ preferably represents a halogen atom, an alkoxycarbonyl group, an aryloxycarbonyl group or a carbamoyl group.

n is an integer of 0 to 5. When n is 2 or greater, a plurality of $R^{33}$ groups may be identical with or different from each other. n is preferably 1 or 2. When n=1, the substitution position of $R^{33}$ is preferably m-position to —NH—$SO_2$—. When n=2, it is preferably o- or m-position to —$R^{33}$. More preferably, the substitution positions are 2,5-positions or 3,5-positions, providing that —NH—$SO_2$— lies at 1-position. n is most preferably 2.

In a preferred form of the general formula (MC-II), $R^{31}$ represents an unsubstituted tertiary alkyl group having 3 to 6 carbon atoms. $L^1$ represents an unsubstituted alkylene group having 1 to 3 carbon atoms. $L^2$ represents —$SO_2$— or —CO—. $L^3$ represents a substituted or unsubstituted arylene group having 6 to 16 carbon atoms. $R^{33}$ represents a halogen atom, a carbamoyl group, an alkoxycarbonyl group or an aryloxycarbonyl group. n is 1 or 2.

In a more preferred form of the general formula (MC-II), $R^{31}$ represents a t-butyl group. $L^1$ represents an unsubstituted alkylene group having 1 to 3 carbon atoms. $L^2$ represents —$SO_2$—. $L^3$ represents an arylene group substituted with an alkoxy group having 6 to 26 carbon atoms. $R^{33}$ represents a carbamoyl group or an alkoxycarbonyl group. n is 1 or 2.

With respect to the couplers of the present invention, specific compound examples will be given below, to which the present invention is in no way limited.

1.

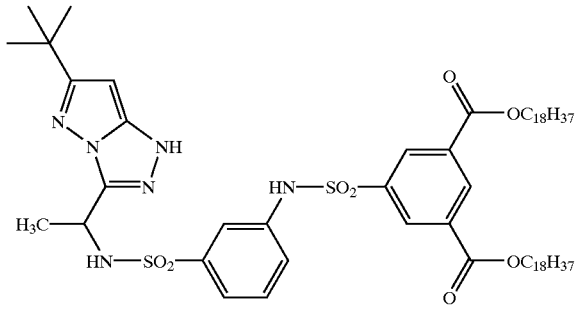

2.

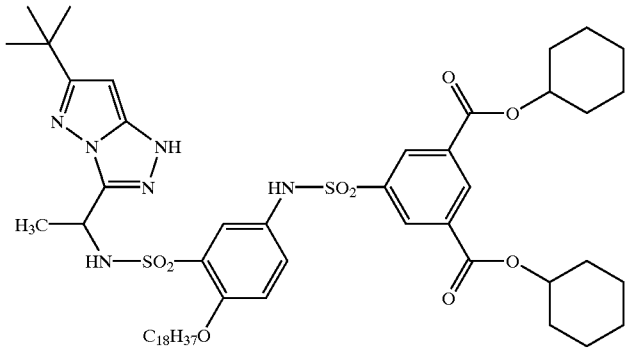

3.

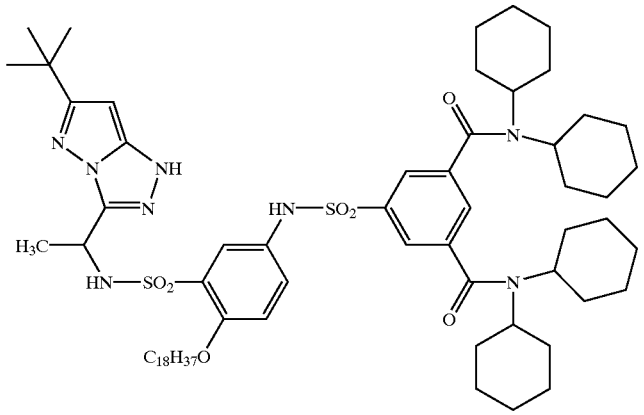

-continued
4.
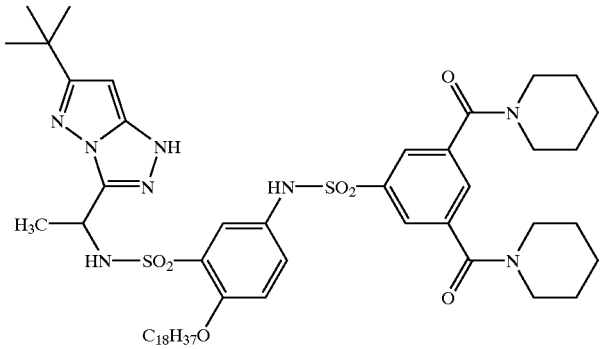
Note:
Alkyl group is a normal-alkyl group unless otherwise indicated.
5.
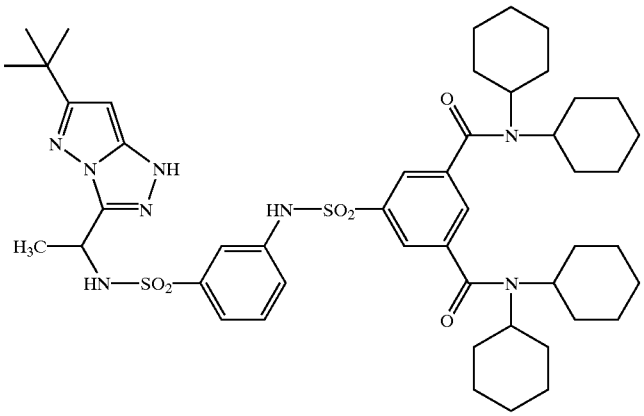
6.
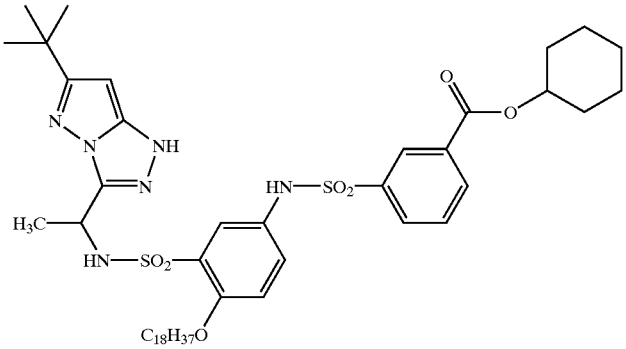
7.
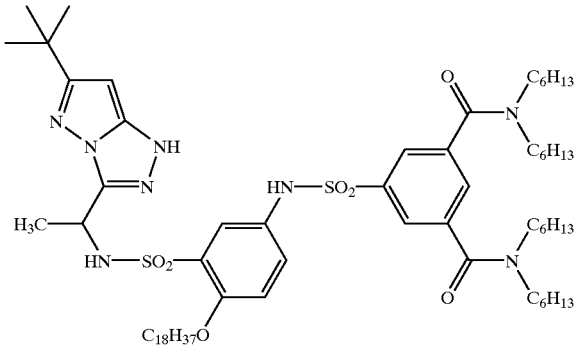

-continued
8.
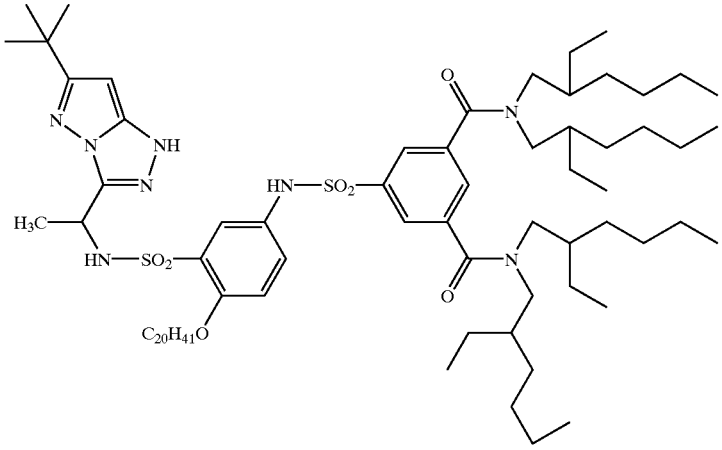
9.
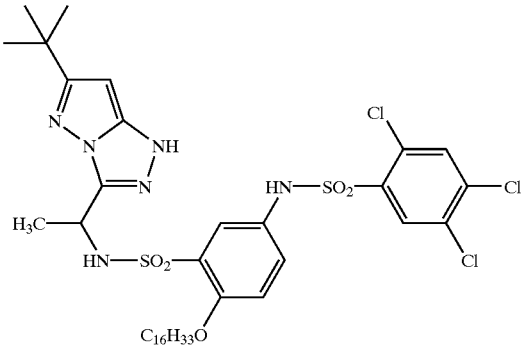
10.
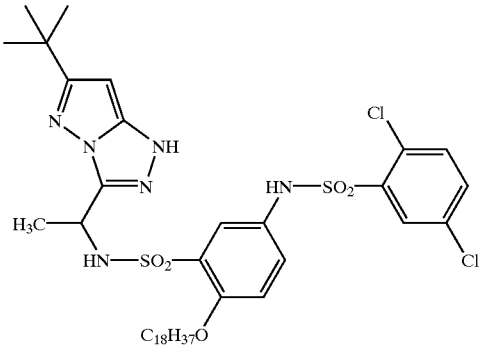
11.
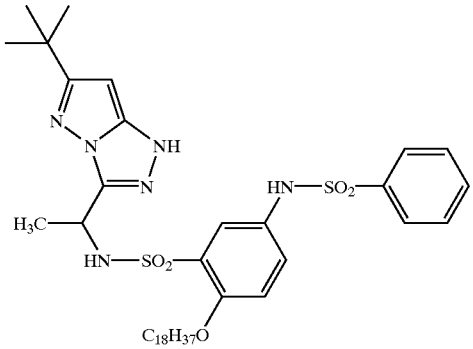

-continued
12.
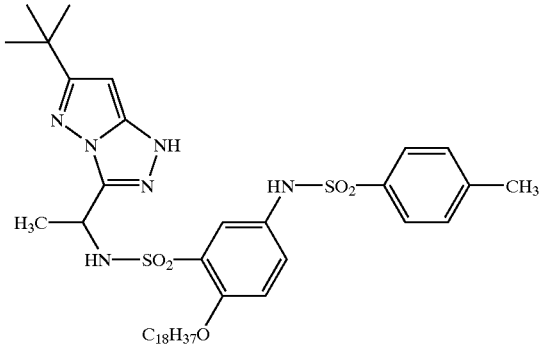
13.
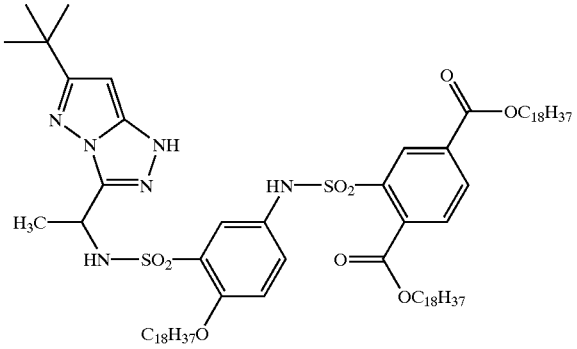
14.
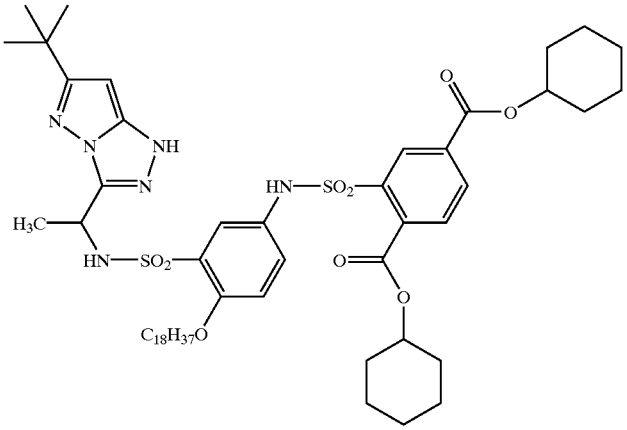
15.
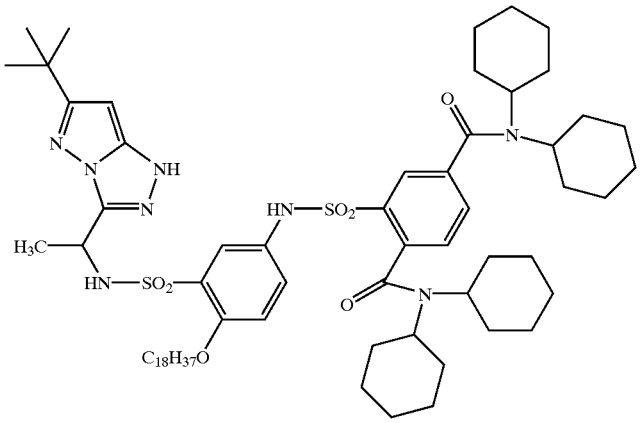

-continued
16.
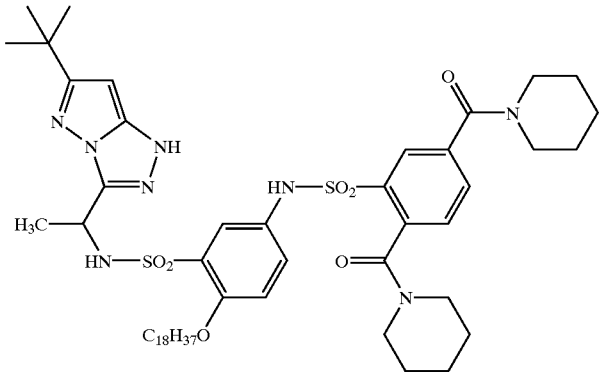
17.
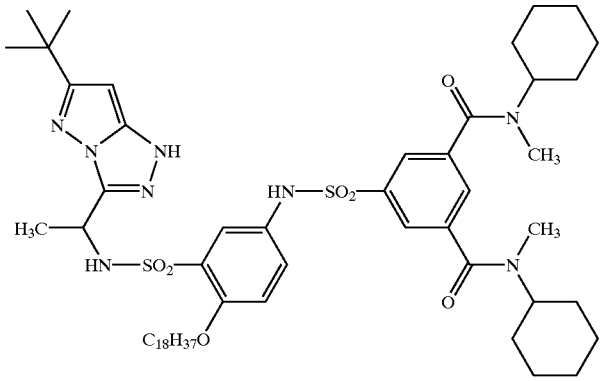
18.
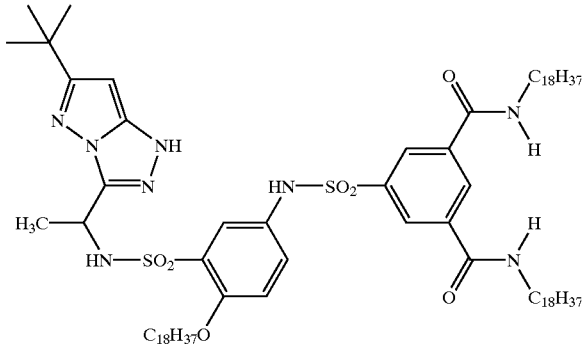
19.
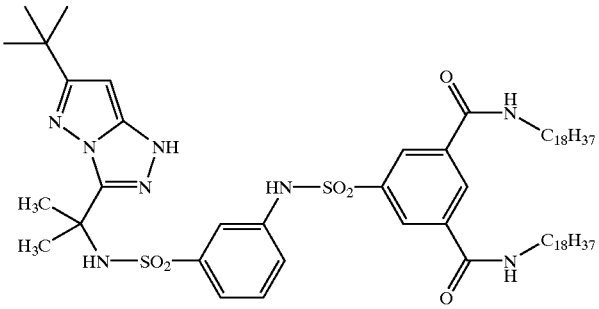

-continued
20.
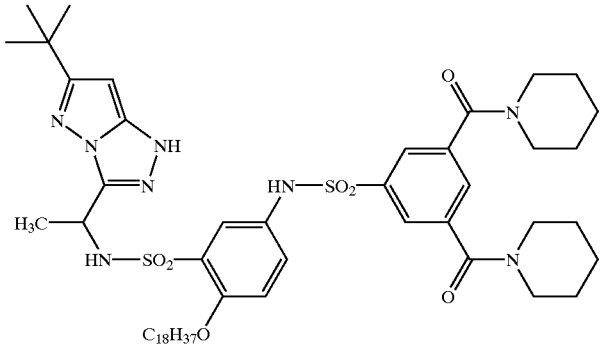
21.
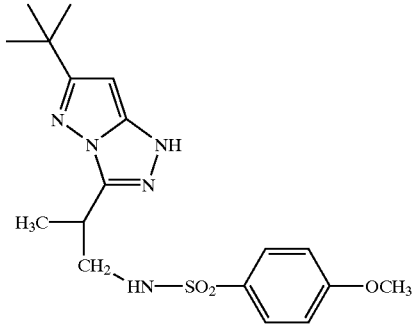
22.
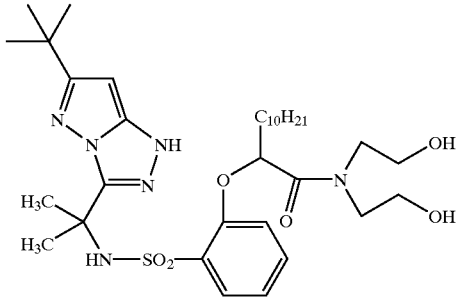
23.
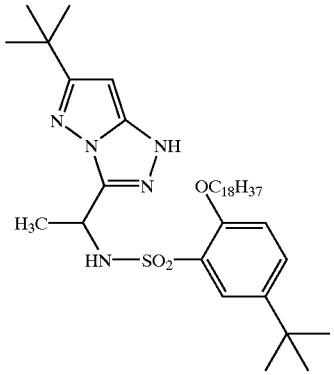

-continued
24.
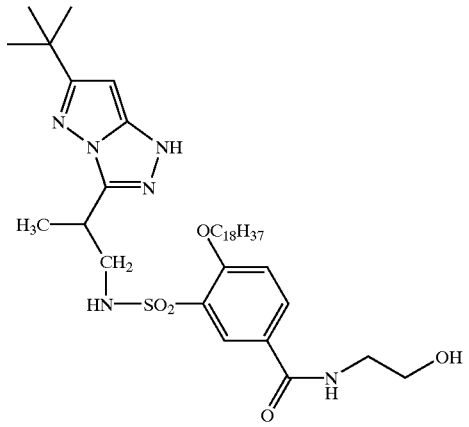
25.
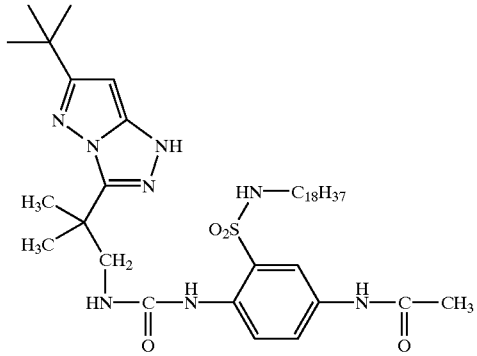
26.
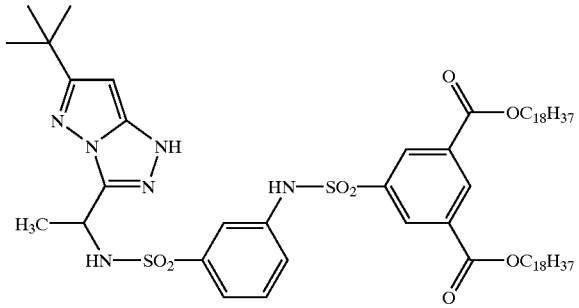
27.
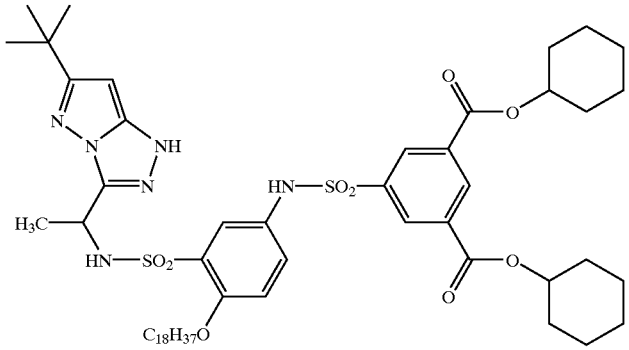

-continued
28.
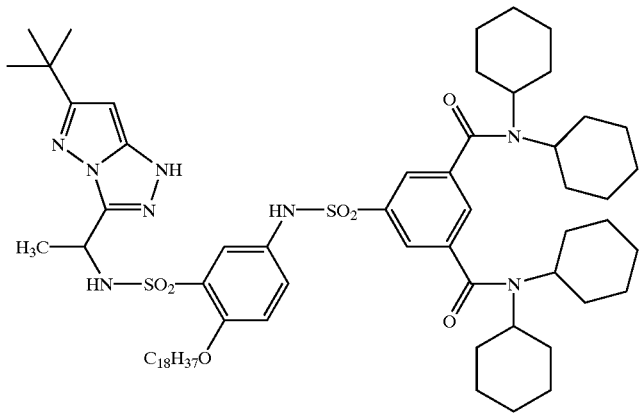
29.
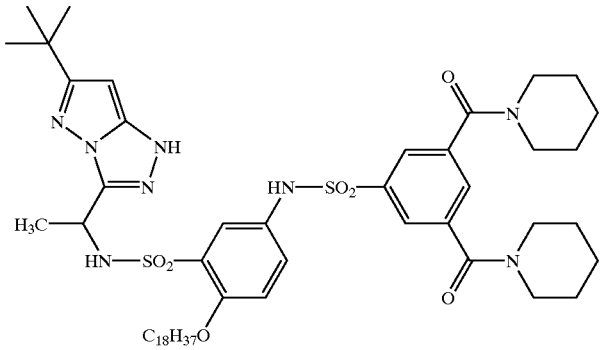
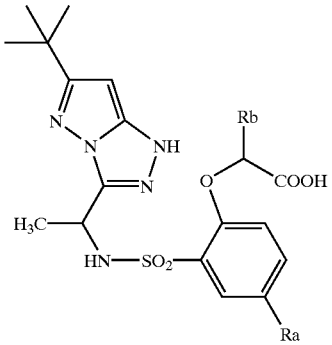
| Compound No. | Ra | Rb |
|---|---|---|
| 30. | 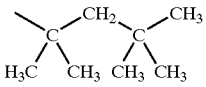 | $—C_6H_{13}$ |
| 31. | 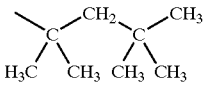 | $—C_8H_{17}$ |
| 32. | 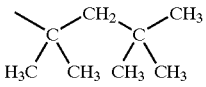 | $—C_{10}H_{21}$ |
| 33. | 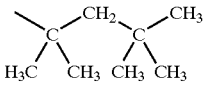 | $—C_{12}H_{25}$ |

-continued
| | | |
|---|---|---|
| 34. | 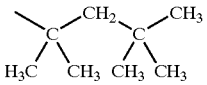 | $—C_{14}H_{29}$ |
| 35. | 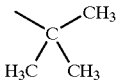 | $—C_{16}H_{33}$ |
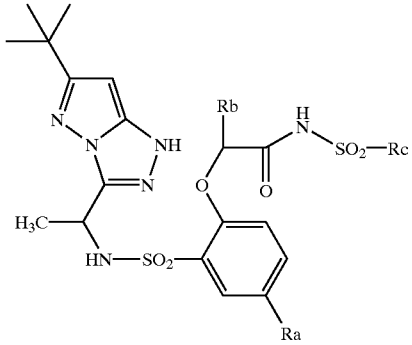
| Compound No. | Ra | Rb | Rc |
|---|---|---|---|
| 36. | 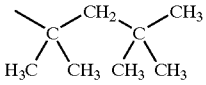 | $—C_6H_{13}$ | $—CH_3$ |
| 37. | 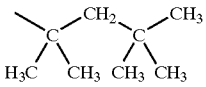 | $—C_8H_{17}$ | $—CH_3$ |
| 38. | 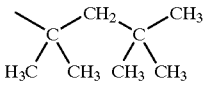 | $—C_{10}H_{21}$ | $—CH_3$ |
| 39. | 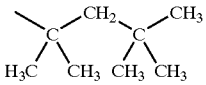 | $—C_{12}H_{25}$ | $—C_2H_5$ |
| 40. | 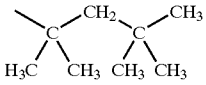 | $—C_{14}H_{29}$ | 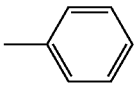 |
| 41. | 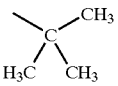 | $—C_{16}H_{33}$ | 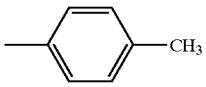 |

-continued

42.

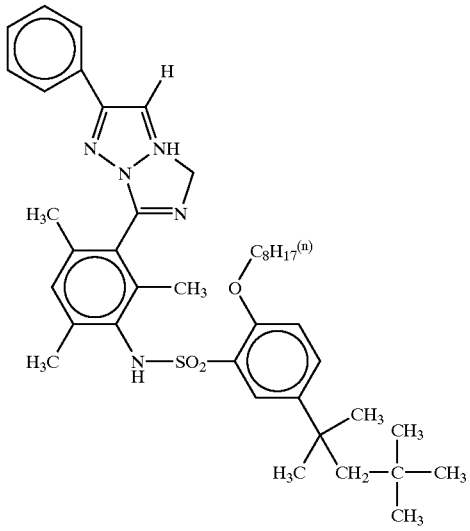

43.

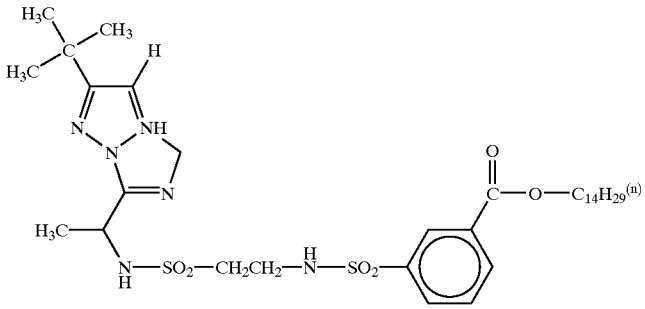

The couplers of the general formula (MC-1) of the present invention can be synthesized by known methods, for example, those described in U.S. Pat. Nos. 4,540,654, 4,705,863 and 5,451,501, JP-A's 61-65245, 62-209457, 62-249155 and 63-41851, Jpn. Pat. Appln. KOKOKU Publication Nos. (hereinafter referred to as JP-B's) 7-122744, 5-105682, 7-13309 and 7-82252, U.S. Pat. Nos. 3,725,067 and 4,777,121, JP-A's 2-201442, 2-101077, 3-125143 and 4-242249.

In the general formula (TS-I), it is preferred that $R^1$ represent any of a hydrogen atom, substituted or unsubstituted alkyl groups (including a cycloalkyl group and a bicycloalkyl group), substituted or unsubstituted alkenyl groups (including a cycloalkenyl group and a bicycloalkenyl group) and substituted or unsubstituted aryl groups.

—$X^1$— preferably represents —O— or —N($R^{24}$)—, wherein $R^{24}$ preferably represents a substituted or unsubstituted alkyl group.

Preferably, $R^2$, $R^3$, $R^4$, $R^5$ and $R^6$ may be identical with or different from each other, and each thereof represents a hydrogen atom, a substituted or unsubstituted alkyl group, a substituted or unsubstituted alkoxy group, a substituted or unsubstituted acylamino group, or a halogen atom.

Among the compounds of the general formula (TS-I), those represented by the following formulae (TS-I-α) and (TS-I-β) are preferred:

(TS-I-α)

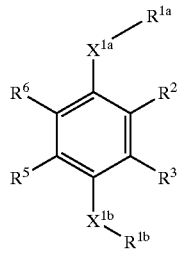

(TS-I-β)

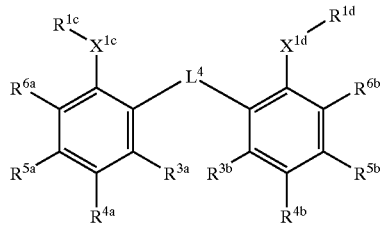

In the formula (TS-I-α), $R^2$, $R^3$, $R^5$ and $R^6$ each independently have the same meaning as the $R^2$, $R^3$, $R^5$ and $R^6$ of the general formula (TS-I). $X^{1a}$ and $X^{1b}$ each independently have the same meaning as the $X^1$ of the general formula (TS-I). $R^{1a}$ and $R^{1b}$ each independently have the same meaning as the $R^1$ of the general formula (TS-I).

In the formula (TS-I-β), $R^{3a}$, $R^{3b}$, $R^{4a}$, $R^{4b}$, $R^{5a}$, $R^{5b}$, $R^{6a}$ and $R^{6b}$ each independently have the same meaning as the $R^3$, $R^4$, $R^5$ and $R^6$ of the general formula (TS-I). $X^{1c}$ and $X^{1d}$ each independently have the same meaning as the $X^1$ of the general formula (TS-I). $R^{1c}$ and $R^{1d}$ each independently have the same meaning as the $R^1$ of the general formula (TS-I). $L^4$ represents a substituted or unsubstituted alkylene group having 1 to 20 carbon atoms.

Among the compounds of the formula (TS-I-α), those wherein each of $R^2$, $R^3$, $R^5$ and $R^6$ independently represents a hydrogen atom, a substituted or unsubstituted alkyl group having 1 to 20 carbon atoms, a halogen atom, a substituted or unsubstituted alkoxy group having 1 to 20 carbon atoms or an acylamino group having 1 to 20 carbon atoms are preferred. Preferably, each of $X^{1a}$ and $X^{1b}$ independently represents —O— or —N($R^{24}$)—, wherein $R^{24}$ preferably represents a hydrogen atom or a substituted or unsubstituted alkyl group having 1 to 20 carbon atoms. Further, preferably, each of $R^{1a}$ and $R^{1b}$ independently represents a substituted or unsubstituted alkyl group having 1 to 20 carbon atoms or a substituted or unsubstituted aryl group having 6 to 20 carbon atoms.

More preferably, $X^{1a}$ and $X^{1b}$ simultaneously represent —O—, or the one thereof represents —N($R^{24}$)— while the other represents —O—. Further, more preferably, $R^{1a}$ and $R^{1b}$ represent substituted or unsubstituted alkyl groups having 1 to 20 carbon atoms.

Among the compounds of the formula (TS-I-β), those wherein each of $R^{3a}$, $R^{3b}$, $R^{4a}$, $R^{4b}$, $R^{5a}$, $R^{5b}$, $R^{6a}$ and $R^{6b}$ independently represents a hydrogen atom, a substituted or unsubstituted alkyl group having 1 to 20 carbon atoms, a halogen atom or an acylamino group having 1 to 20 carbon atoms are preferred. Preferably, each of $X^{1c}$ and $X^{1d}$ independently represents —O—. Further, preferably, each of $R^{1c}$ and $R^{1d}$ independently represents a hydrogen atom, a substituted or unsubstituted alkyl group having 1 to 20 carbon atoms, an acylamino group having 2 to 20 carbon atoms, or a substituted or unsubstituted alkenyl group having 3 to 20 carbon atoms. $L^4$ preferably represents an unsubstituted alkylene group having 1 to 20 carbon atoms.

More preferably, $R^{1c}$ and $R^{1d}$ simultaneously represent hydrogen atoms, and $R^{3a}$, $R^{3b}$, $R^{4a}$, $R^{4b}$, $R^{5a}$, $R^{5b}$, $R^{6a}$ and $R^{6b}$ simultaneously represent hydrogen atoms. Further, more preferably, $L^4$ represents an unsubstituted alkylene group having 1 to 8 carbon atoms.

In a preferred form of the structure of compound of the formula (TS-I-β), each of $R^{4a}$, $R^{4b}$, $R^{6a}$ and $R^{6b}$ independently represents an unsubstituted alkyl group having 1 to 8 carbon atoms. $R^{1c}$, $R^{1d}$, $R^{3a}$, $R^{3b}$, $R^{5a}$ and $R^{5b}$ simultaneously represent hydrogen atoms. $X^{1c}$ and $X^{1d}$ simultaneously represent —O—. $L^4$ represents an unsubstituted alkylene group having 1 to 8 carbon atoms.

Among the compounds of the general formula (TS-II), those wherein each of $R^{11}$, $R^{12}$, $R^{13}$ and $R^{14}$ represents an unsubstituted alkyl group having 1 to 10 carbon atoms or an alkenyl group having 2 to 10 carbon atoms are preferred. More preferably, $R^{11}$, $R^{12}$, $R^{13}$ and $R^{14}$ are the same and represent an unsubstituted alkyl group having 1 to 3 carbon atoms. Still more preferably, $R^{11}$, $R^{12}$, $R^{13}$ and $R^{14}$ simultaneously represent a methyl group. $R^{11}$ and $R^{12}$, or $R^{13}$ and $R^{14}$, may be bonded with each other to thereby form a 5 to 7 membered ring. $X^2$ preferably represents any of a hydrogen atom, alkyl groups (including a cycloalkyl group and a bicycloalkyl group), alkenyl groups (including a cycloalkenyl group and a bicycloalkenyl group), alkoxy groups (including a cycloalkyloxy group), acyl groups, acyloxy groups, a hydroxyl group and an oxyl group. $X^2$ more preferably represents an unsubstituted alkoxy group having 1 to 20 carbon atoms (including a cycloalkyloxy group) or an oxyl group. $X^3$ preferably represents an atom group required for forming a nitrogen containing 6-membered ring.

In a preferred form of the general formula (TS-II), $R^{11}$, $R^{12}$, $R^{13}$ and $R^{14}$ simultaneously represent a methyl group. $X^2$ represents an unsubstituted alkoxy group having 1 to 20 carbon atoms (including a cycloalkyloxy group) or an oxyl group. $X^3$ represents an atom group required for forming a nitrogen containing 6-membered ring.

In the general formula (TS-III), each of $R^{21}$ and $R^{22}$ independently has the same meaning as the above $R^1$. $R^{21}$ preferably represents a hydrogen atom. $R^{22}$ preferably represents a substituted or unsubstituted alkyl group having 1 to 20 carbon atoms, or an aryl group having 6 to 20 carbon atoms. $R^{22}$ more preferably represents an unsubstituted alkyl group having 1 to 5 carbon atoms. $X^4$ preferably represents —CO—$R^{123}$, —CO—O—$R^{123}$ or —CO—N$R^{124}$($R^{125}$) wherein $R^{123}$ preferably represents a substituted or unsubstituted alkyl group, or a substituted or unsubstituted aryl group. Preferably, each of $R^{124}$ and $R^{125}$ independently represents a hydrogen atom, a substituted or unsubstituted alkyl group, or a substituted or unsubstituted aryl group. $X^4$ most preferably represents —CO—$R^{123}$, wherein $R^{123}$ represents a substituted or unsubstituted alkyl group.

Among the compounds of the general formula (TS-III), those wherein $R^{21}$ represents a hydrogen atom, $R^{22}$ represents an unsubstituted alkyl group having 1 to 5 carbon atoms and $X^4$ represents —CO—$R^{123}$, —CO—O—$R^{123}$ or —CO—N$R^{124}$($R^{125}$), in which $R^{123}$ represents a substituted or unsubstituted alkyl group while each of $R^{124}$ and $R^{125}$ independently represents a hydrogen atom, a substituted or unsubstituted alkyl group or a substituted or unsubstituted aryl group, are preferred.

Among the compounds represented by the general formula (TS-I), the compounds represented by the general (TS-II) and the compounds represented by the general (TS-III), preventives having the structure of the general formula (TS-III) are highly effective and preferred.

One or two or more compounds represented by the general formula (TS-I) can be incorporated in the lightsensitive material. The compounds can be incorporated in the same layer or in different layers. This is also true with respect to the compounds represented by the general formula (TS-II) or (TS-III). Further, the lightsensitive material can be simultaneously loaded with the compounds of the general formulae (TS-I), (TS-II) and (TS-III). It is preferred to incorporate at least one compound selected from the compound of the general formulae (TS-I), (TS-II) and (TS-III), and the coupler of the general formula (MC-I) in the same layer.

The molecular weight of each of the compounds of the general formulae (TS-I), (TS-II) and (TS-III) is preferably 150 or more, more preferably 200 or more, still more preferably 250 or more, and most preferably 300 or more. The molecular weight is preferably 1000 or less, more preferably 800 or less. The addition amount of each of the compounds of the general formulae (TS-I), (TS-II) and (TS-III) is in the range of 0.05 to 50 mol/$m^2$, preferably 0.1 to 10 mol/$m^2$, and more preferably 0.5 to 5 mol/$m^2$. It is preferred that the compounds of the general formulae (TS-I), (TS-II) and (TS-III) be added to the layer wherein the coupler of the general formula (MC-I) is contained. The compounds are added in an amount of 1 to 300 mmol %, preferably 10 to 100 mmol %, based on the total amount of the coupler contained in the layer.

With respect to the preventives of the general formulae (TS-I), (TS-II) and (TS-III), compound examples will be given below. The present invention is in no way limited to the compound examples given below.
1
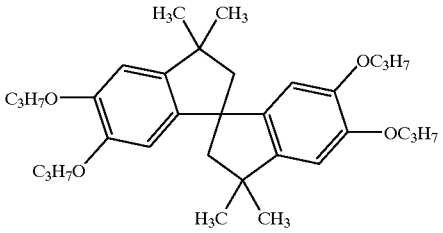
2
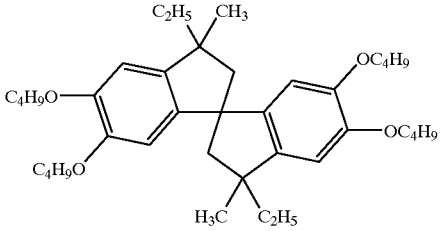
3
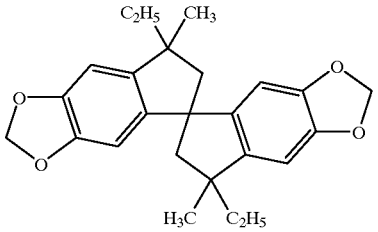
4
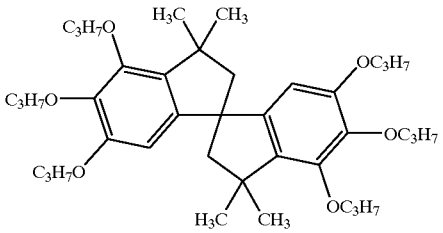
5
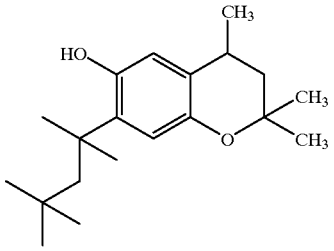
6
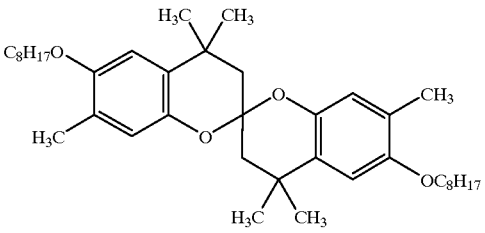
-continued
7
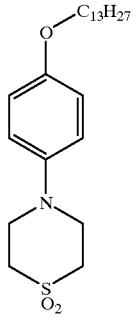
8
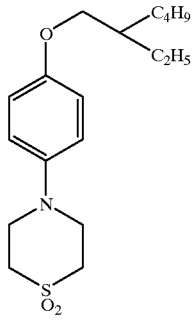
9
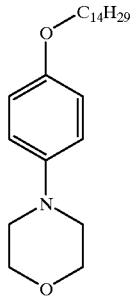
10
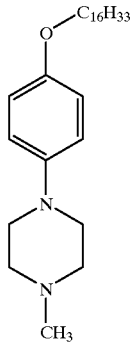
11
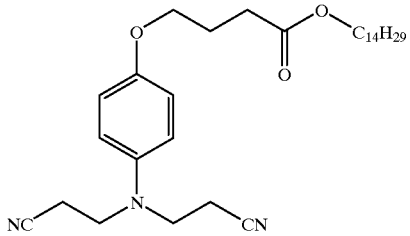

-continued
12
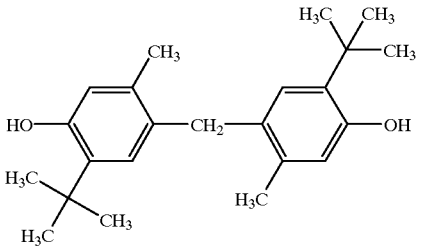
13
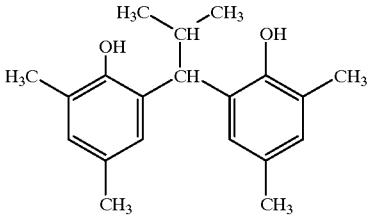
14
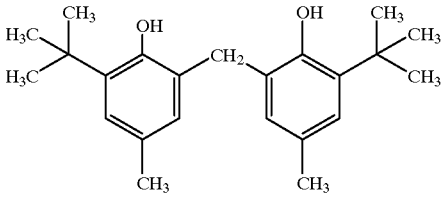
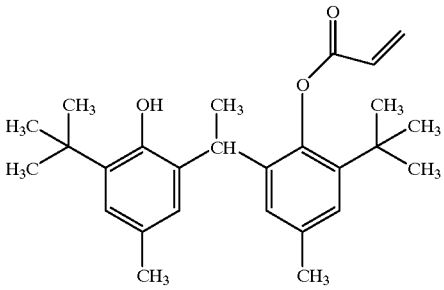
16
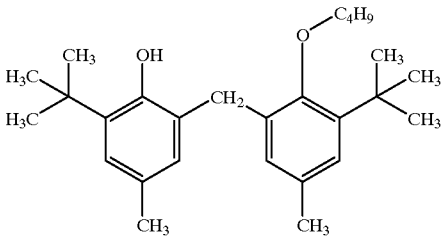
17
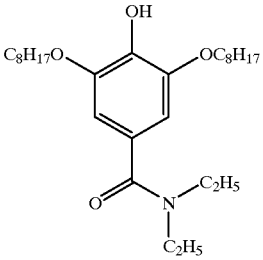
-continued
18
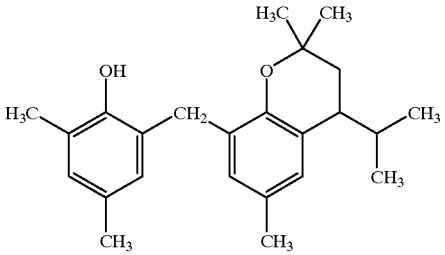
19
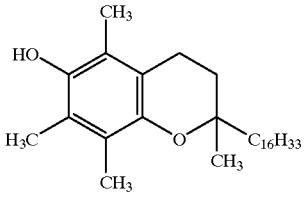
20
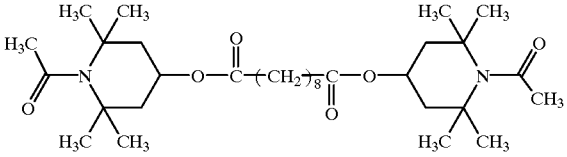
21
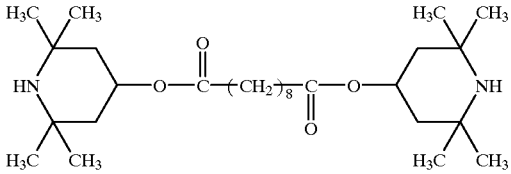
22
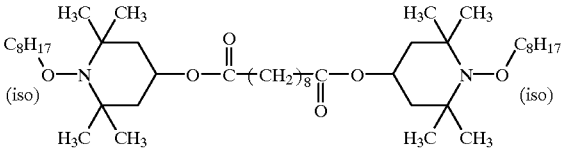
23
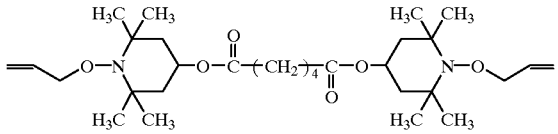
24
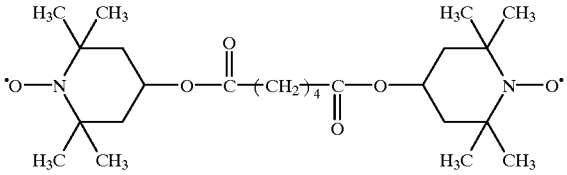
25
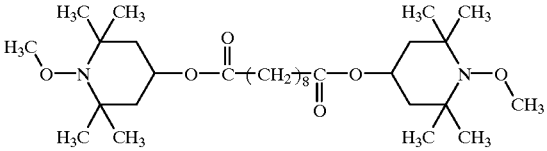

-continued
26
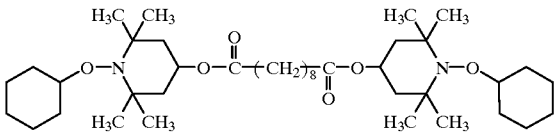
27
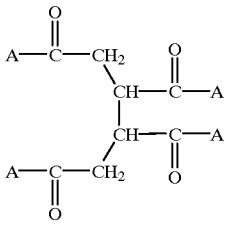
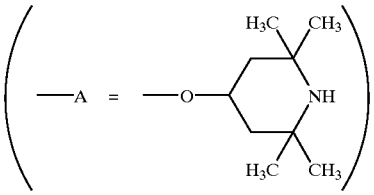
28
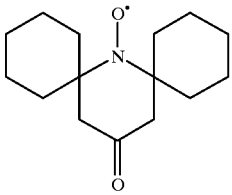
29
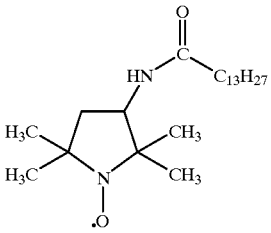
30
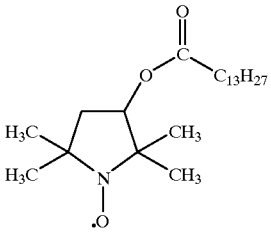
31
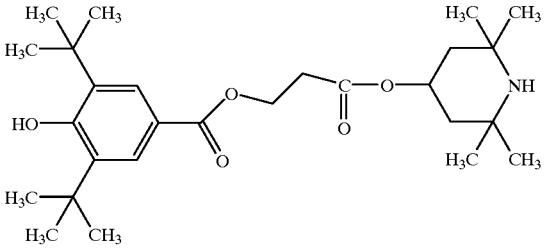
-continued
32
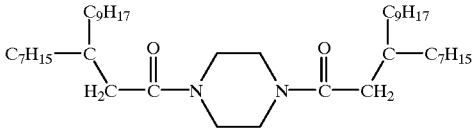
33
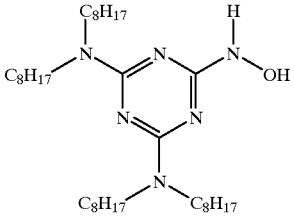
34
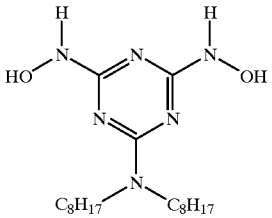
35
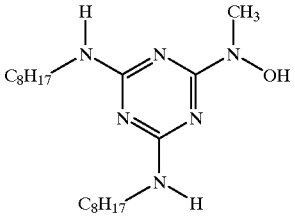
36
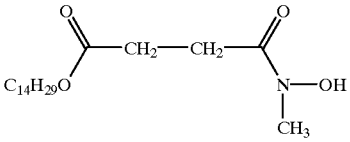
37
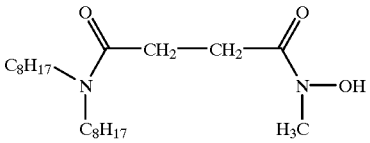
38
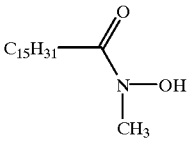
39
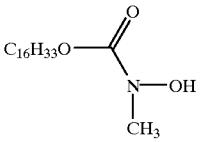

-continued
40
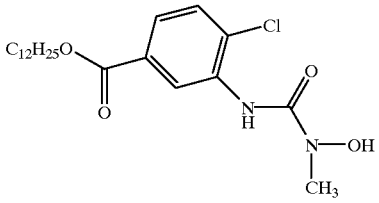
41
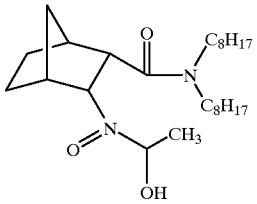
42
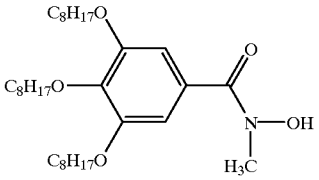
43
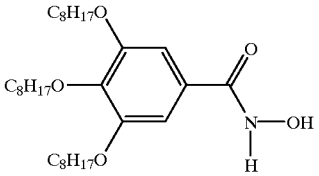
44
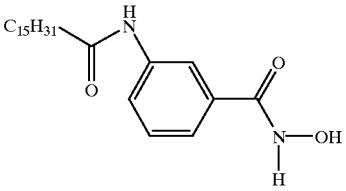
45
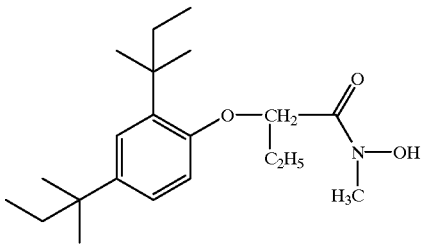
46
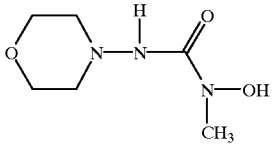
47
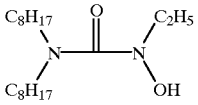
-continued
48
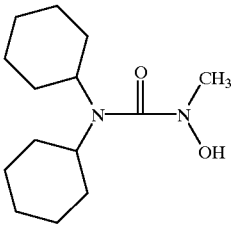
49
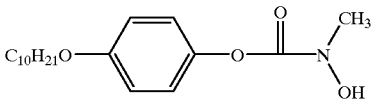
50
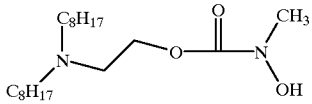
51
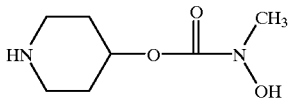
52
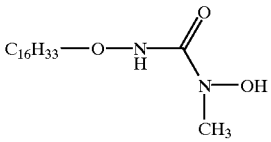
53
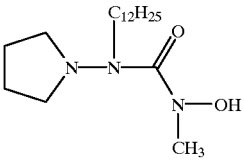
54
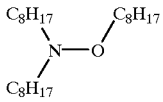
55
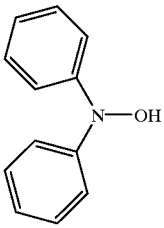
56
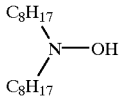
57
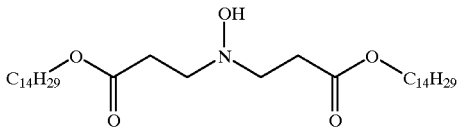

-continued

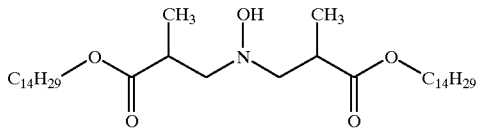

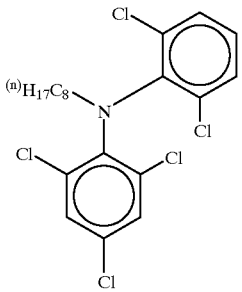

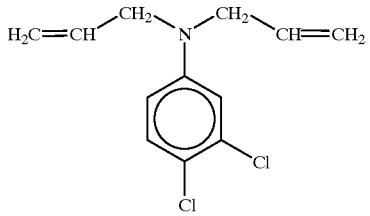

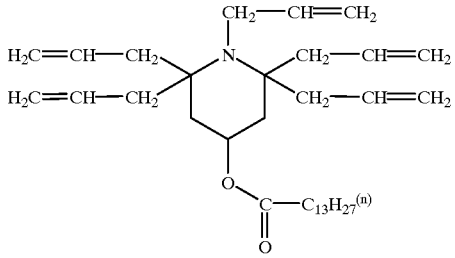

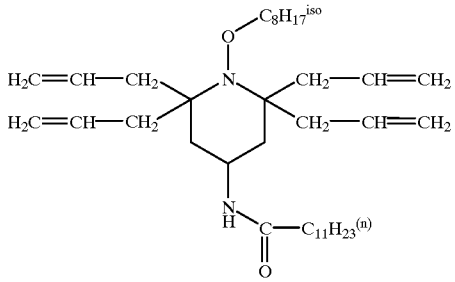

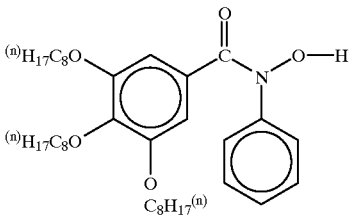

Compounds of the general formulae (TS-I), (TS-II) and (TS-III) are known, and relevant patents are cited in, for example, Research Disclosure Nos. 17643 (IV, items I to J), 15162, 18716 (page 650, left column), 36544 (page 527), 307105 (page 872) and 15162.

The coupler of the general formula (MC-I) or (MC-II) according to the present invention is incorporated in the lightsensitive material in an amount of 0.01 to 10 g, preferably 0.1 to 2 g, per $m^2$ of lightsensitive material. The coupler is appropriately incorporated in the lightsensitive material in an amount of $1\times10^{-3}$ to 1 mol, preferably $2\times10^{-3}$ to $3\times10^{-1}$ mol, per mol of silver halide contained in the same lightsensitive emulsion layer.

One or two or more couplers represented by the general formula (MC-I) can be incorporated in the lightsensitive material. The couplers can be incorporated in the same layer or in different layers. The same can be applied to the coupler represented by the general formula (MC-II). Further, the lightsensitive material can be simultaneously loaded with the coupler of the general formula (MC-I) and the coupler of the general formula (MC-II).

When the lightsensitive layer has a unit constitution including a plurality of lightsensitive emulsion layers with identical color sensitivities but with different speeds, it is preferred that the content of each coupler per mol of silver halide be in the range of $2\times10^{-3}$ to $1\times10^{-1}$ mol in a low-speed layer, $3\times10^{-2}$ to $3\times10^{-1}$ mol in an intermediate-speed layer, and $3\times10^{-2}$ to $3\times10^{-1}$ mol in a high-speed layer.

The coupler represented by the general formula (MC-1) or (MC-II) according to the present invention can be introduced in the lightsensitive material by various conventional dispersion methods. The introduction is preferably performed by an oil-in-water dispersion method of dispersing oil drops in water wherein the coupler is dissolved in a high-boiling organic solvent (in combination with a low-boiling solvent if necessary), emulsified and dispersed in an aqueous gelatin solution in the presence of a surfactant, and added to a silver halide emulsion.

Examples of the high-boiling solvent used in this oil-in-water dispersion method are described in, e.g., U.S. Pat. No. 2,322,027. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104. Dispersion using an organic solvent-soluble polymer is described in PCT International Publication W088/00723.

Examples of the high-boiling solvent usable in the above-mentioned oil-in-water dispersion method are phthalic acid esters (e.g., dibutylphthalate, dioctylphthalate, dicyclohexylphthalate, di-2-ethylhexylphthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and di-2-ethylhexylphenylphosphate), benzoic acid esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide and N,N-diethyllaurylamide), alcohols and phenols (e.g., isostearylalcohol, 2,4-di-tert-amylphenol, and glycerin mono-oleyl), aliphatic esters (e.g., dibutoxyethyl succinate, di-2-ethylhexyl succinate, 2-hexyldecyl tetradecanate, tributyl citrate, diethylazelate, isostearyllactate, and trioctyltosylate), aniline derivatives (e.g., N,N-dibutyl-2-butoxy-5-tert-octylaniline), chlorinated paraffins (paraffins containing 10% to 80% of chlorine), trimesic acid esters (e.g., tributyl trimeslate), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy) butyric acid and 2-ethoxyoctanedecanic acid), alkylphosphoric acids (e.g., di-(2-ethylhexyl)phosphoric acid and diphenylphosphoric acid). In addition to the above high-boiling solvents, compounds described in, e.g., JP-A-6-258803, the disclosure of which is herein incorporated by reference, can also be preferably used as high-boiling solvents.

Of these compounds, phosphoric acid esters are preferable, and the combination of phosphoric acid esters with alcohols or phenols is also preferable.

In the present invention, the weight ratio of a high-boiling organic solvent to the coupler represented by formula (MC-1) is preferably 0 to 2.0, more preferably, 0.01 to 1.0, and most preferably, 0.01 to 0.5.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C., in combination.

In the lightsensitive material of the present invention, it is only essential that at least one silver halide emulsion layer (preferably, green-sensitive emulsion layer) containing the coupler represented by the general formula (MC-1) or (MC II) according to the present invention be disposed on a support. The general lightsensitive material can be constituted by coating a support with at least one blue-sensitive silver halide emulsion layer, at least one green-sensitive silver halide emulsion layer and at least one red-sensitive silver halide emulsion layer in this sequence. The coating may be performed in a sequence different therefrom.

In the present invention, it is preferred that the coating be performed in the sequence of, from the side close to the support, the red-sensitive silver halide emulsion layer, the green-sensitive silver halide emulsion layer and the blue-sensitive silver halide emulsion layer. Further, it is preferred that each of the color sensitive layers have a unit constitution including a plurality of lightsensitive emulsion layers with different speeds. It is especially preferred that each of the color sensitive layers have a three-layer unit constitution composed of three lightsensitive emulsion layers consisting of a low-speed layer, an intermediate-speed layer and a high-speed layer arranged in this sequence from the side close to the support. Although the coupler represented by the general formula (MC-1) or (MC-II) according to the present invention can be incorporated in any of a low-speed layer, an intermediate-speed layer and a high-speed layer, it is preferred that the incorporation be effected in a low-speed layer.

In the lightsensitive material of the present invention, a spectral sensitization is effected in blue, green and red sensitivities. The wavelength realizing the maximum value of sensitivity of each lightsensitive layer is preferably in the range of 430 to 460 nm with respect to a blue-sensitive layer, 520 to 560 nm with respect to a green-sensitive layer, and 600 to 650 nm with respect to a red-sensitive layer.

The lightsensitive material of the present invention may include a lightsensitive emulsion layer exhibiting a sensitivity in wavelength regions other than the above blue, green and red sensitivities according to necessity. In particular, faithfulness in color reproduction can be enhanced by disposing such a fourth lightsensitive layer that the wavelength realizing the maximum value of sensitivity is in the range of 480 to 530 nm and by restricting the development of a red-sensitive layer as a function of development of the layer. This is preferably applied to the lightsensitive material of the present invention.

In the present invention, in addition to the coupler capable of forming a dye which is in a complementary color relationship with the color sensitivity of emulsion, a coupler which forms a color in other hue may be mixed and used. For example, in the high-speed layer and intermediate-speed layer of a green-sensitive emulsion unit, not only the coupler of the general formula (MC-I) according to the present invention but also a cyan coloring coupler or black coloring coupler can be mixed to thereby enhance a shadow descriptive capability.

Moreover, the coupler of the general formula (MC-I) or (MC-II) according to the present invention may be used in combination with other magenta couplers. Other magenta couplers for combination use are preferably 1-phenyl-3-acylamino-5-pyrazolone magenta couplers, more preferably couplers represented by the following formulae (MCP-1), (MCP-2) and (MCP-3).

MCP-1

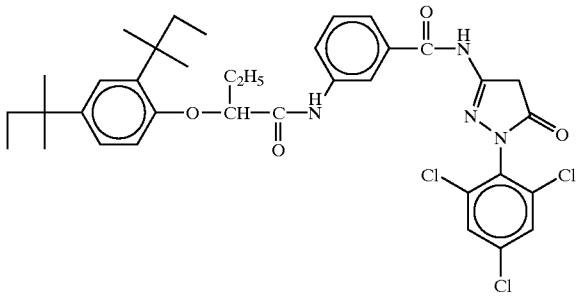

MCP-2

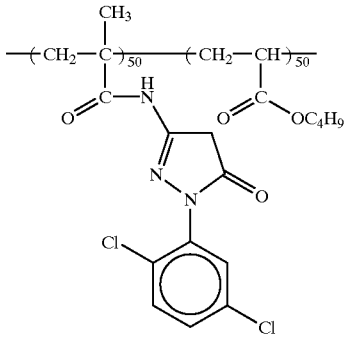

(The numbers are in wt. %)

MCP-3

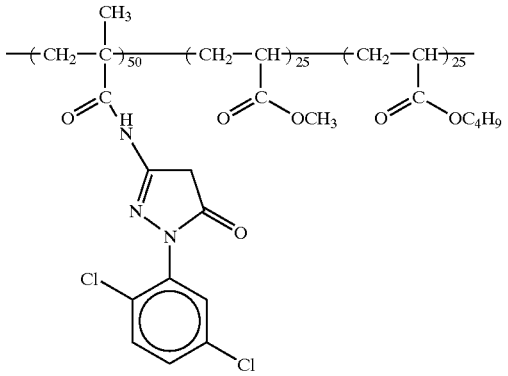

(The numbers are in wt. %)

When the coupler of the general formula (MC-I) or (MC-II) according to the present invention is used in combination with other magenta couplers, the former is preferably used in a molar ratio, relative to the latter, of 30% or more, more preferably 50% or more.

When the coupler of the general formula (MC-I) or (MC-II) according to the present invention is used in combination with other magenta couplers, the total content of the couplers is in the range of 0.01 to 10 g, preferably 0.1 to 2 g, per $m^2$ of lightsensitive material. The coupler content is suitably in the range of $1\times10^{-3}$ to 1 mol, preferably $2\times10^{-3}$ to $3\times10^{-1}$ mol, per mol of silver halide contained in the same lightsensitive emulsion layer.

The lightsensitive material of the present invention may further be loaded with a competing compound (compound which reacts with color developing agent in an oxidized form while competing with image forming couplers but does not form any dye images). The competing compound can be, for example, a reducing compound selected from among hydroquinones, catechols, hydrazines, sulfonamidophenols, etc. or a compound which couples with color developing agent in an oxidized form but substantially does not form color images (e.g., any of non-dye-forming couplers as disclosed in DE No. 1,155,675, GB No. 861,138 and U.S. Pat. Nos. 3,876,428 and 3,912,513 or any of flow-out couplers as disclosed in JP-A-6-83002).

The competing compound is preferably added to a lightsensitive emulsion layer containing the magenta coupler of the general formula (MC-I) or (MC-II) according to the present invention or a non-lightsensitive layer. More preferably, the addition is effected to lightsensitive emulsion layers containing the magenta coupler of the general formula (MC-I) or (MC-II) according to the present invention. The addition amount of competing compound is in the range of 0.01 to 10 g, preferably 0.05 to 5.0 g, per $m^2$ of lightsensitive material. The addition amount is in the range of 1 to 1000 mol %, preferably 20 to 500 mol %, based on the coupler of the general formula (MC-I) or (MC-II) according to the present invention.

In the lightsensitive material of the present invention, a non-color-forming interlayer may be incorporated in a lightsensitive unit of the same color sensitivity. Further, a compound which can be selected as the above competing compound is preferably contained in the interlayer.

For preventing the deterioration of photographic performance by formaldehyde gas, it is preferred that the lightsensitive material of the present invention be loaded with a compound capable of reacting with formaldehyde gas to thereby immobilize it as described in U.S. Pat. Nos. 4,411,987 and 4,435,503.

Various techniques and organic and inorganic materials which can be used in the silver halide photographic lightsensitive materials of the invention and silver halide photographic emulsions used therein are generally those described in Research Disclosure No. 308119 (1989), ditto 37038 (1995), ditto 40145 (1997), the disclosures of which are incorporated herein by reference.

In addition, more specifically, techniques and inorganic and organic materials usable in color photographic materials of the present invention and in silver halide emulsion used therein are described in portions of EP436,938A2 and patents cited below.

| Items | corresponding portions |
|---|---|
| 1) Layer configurations | page 146, line 34 to page 147, line 25 |
| 2) Silver halide emulsions usable together | page 147, line 26 to page 148 line 12 |

-continued

| Items | corresponding portions |
|---|---|
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 14) Film thickness film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing.stabilizing steps | page 153, lines 3 to 37 |

The lightsensitive material of the present invention can be developed by a conventional development processing. The pH value of a color developer for use in the processing is to be 9.5 or higher. However, the exertion of the effect of the present invention is striking in the processing with the use of a color developer having a pH value of 11.0 or higher. The exertion of the effect of the present invention is the most striking in the processing with the use of a color developer having a pH value of 11.5 or higher.

The development processing preferably employed in the present invention will be described below.

Known developing agents can be used in the first black and white developer and replenisher thereof for use in the present invention. As developing agents, there can be mentioned, for example, dihydroxybenzenes (e.g., hydroquinone and hydroquinonemonosulfonates), 3-pyrazolidones (e.g., 1-phenyl-3-pyrazolidone), aminophenols, ascorbic acid and heterocyclic compounds such as a condensate of 1,2,3,4-tetrahydroquinoline ring and indoline ring described in U.S. Pat. No. 4,067,872. These can be used individually or in combination. Preferred developing agents are potassium hydroquinonemonosulfonate and sodium hydroquinonemonosulfonate.

The preservative for use in the first black and white developer and replenisher according to the present invention preferably consists of, for example, a sulfite or a bisulfite. The sulfite concentration of the developer is in the range of 0.01 to 10 mol/liter (liter hereinafter also referred to as "L"), preferably 0.1 to 1 mol/L. Also, hydroxylamines of the general formula (I) of JP-A-3-144446 can be used as the preservative.

Furthermore, in the first black and white developer and replenisher according to the present invention, use can be made of, for example, a buffer (e.g., a carbonate, a borate, an alkanolamine or sulfosalicylic acid), a hydroxide (e.g., potassium hydroxide or sodium hydroxide), a dissolution auxiliary (e.g., a polyethylene glycols), a sensitizer (e.g., a quaternary ammonium salt), a silver halide solvent (e.g., KSCN or NaSCN), a development accelerator, a surfactant and a film hardener.

The pH value of the first black and white developer and replenisher according to the present invention is preferably in the range of 8.0 to 11.0, more preferably 9.0 to 10.5, and most preferably 9.5 to 10.0.

The standard processing time with the use of the first black and white developer according to the present invention is 6 min. Sensitization and desensitization cab be effected by appropriately changing the processing time. The processing time is generally changed within the range of 3 to 18 min.

The quantity of replenisher fed to the first black and white developer according to the present invention is generally in the range of 2 to 2.5 L per $m^2$ of processed lightsensitive material. In recent years, for reducing the amount of waste liquid, 0.5 to 1.5 L processing is also being carried out.

It is preferred to minimize the contact area between liquid and air in the processing solution tank and the replenisher tank from the viewpoint that an oxidation deterioration can be prevented. The contact area of photographic processing solution with air in the processing solution tank and the replenisher tank can be expressed by the open ratio defined as:

$$\text{open ratio}=[\text{area of contact of processing solution with air } (cm^2)]/[\text{volume of processing solution } (cm^3)].$$

This open ratio is preferably 0.1 or less, more preferably in the range of 0.001 to 0.05. The lowering of the open ratio can be accomplished not only by disposing a shield such as a floating cover on the surface of photographic processing solution of the processing tank and replenisher tank but also by the method of JP-A-1-82033 in which a movable cover is used or the method of JP-A-63-216050 in which a slit development processing method is conducted. The lowering of the open ratio is preferably applied to not only the two steps of color development and black and white development but also all the subsequent steps such as bleaching, bleach-fix, fixing, washing and stabilization. Further, the quantity of replenisher can be reduced by employing means for suppressing the accumulation of bromide ions in the developer.

The reversal bath or light fogging step conventionally employed after the first black and white development can be omitted in the present invention. However, when it is not omitted, known fogging agents, for example, stannous ion complex salts such as stannous ion/organophosphate complex salts (U.S. Pat. No. 3,617,282), stannous ion organophosphonocarboxylate complex salts (JP-B-56-32616) and stannous ion/aminopolycarboxylate complex salts (U.S. Pat. No. 1,209,050) and boron compounds such as boron hydride compounds (U.S. Pat. No. 2,984,567) and heterocyclic amineboran compounds (GB No. 1,011,000) are used in the reversal bath. The pH value of the reversal bath widely ranges from the acid region to the alkali region, depending on the type of fogging agent. The pH value is in the range of 2 to 12, frequently 2.5 to 10, and especially 3 to 9.

In the present invention, the color developer contains an aromatic primary amine color developing agent. The color developing agent is used in an amount of 1 to 20 g, preferably 2 to 15 g, per L of color developer.

Color developing agents may be used individually or in combination. Specific compounds will be listed below, to which, however, the color developing agents of the present invention are in no way limited.

D-1: N,N-diethyl-p-phenylenediamine,

D-2: 2-amino-5-diethylaminotoluene,

D-3: 2-amino-5-(N-ethyl-N-laurylamino)toluene,

D-4: 4-[N-ethyl-N-(β-hydroxyethyl)amino]aniline,

D-5: 2-methyl-4-[N-ethyl-N-(β-hydroxyethyl)amino]aniline,

D-6: 4-amino-3-methyl-N-ethyl-N-[β-(methanesulfonamido)ethyl]-aniline,

D-7: N-(2-amino-5-diethylaminophenylethyl)methanesulfonamide,

D-8: N,N-dimethyl-p-phenylenediamine,

D-9: 4-amino-3-methyl-N-ethyl-N-methoxyethylaniline,

D-10: 4-amino-3-methyl-N-ethyl-N-β-ethoxyethylaniline, and

D-11: 4-amino-3-methyl-N-ethyl-N-β-butoxyethylaniline.

These color developing agents are generally used in the form of a salt, such as a hydrochloride, a sulfate, a phosphate or a p-toluenesulfonate, or in the form of a hydrate of salt.

The color developing agents preferably employed in the present invention are D-4, D-5 and D-6.

In the present invention, if necessary, a sulfite such as sodium sulfite, potassium sulfite, sodium bisulfite, potassium bisulfite, sodium metasulfite or potassium metasulfite, or a carbonyl compound sulfite adduct, can be added as a preservative to the color developer. The addition amount thereof is preferably 20 g or less, more preferably 10 g or less, and most preferably 0.05 to 5 g, per L of color developer.

In the present invention, a colorless compound forming competing coupler may be added to the color developer in order to regulate the gradation of color image. Colorless compound forming competing couplers are described in U.S. Pat. Nos. 2,742,832, 3,520,690 and 3,645,737 and JP-B's 44-9504, 44-9506 and 44-9507. As especially preferably employed compounds, there can be mentioned, for example, citrazinic acid, J-acid, H-acid and resorcinol. Among these, citrazinic acid is most preferred. In the addition of colorless compound forming competing couplers to the color developer, the addition amount is in the range of 1 to 10 mmol/L.

In the present invention, it is not preferable to use hydroxylamine as a preservative. The reason is that its compatibility with the color developer is poor because of the exhibition of a noncoloring development activity, so that desirable photographic properties (gradation) cannot be obtained. As other preservatives for color developers, there can be mentioned sulfinic acids, α-hydroxyketones and α-aminoketones described in JP-A-63-44656, various saccharides described in JP-A-63-36244, monoamines described in, for example, JP-A's 63-4235, 63-24254, 63-21647, 63-146040, 63-27841 and 63-25654, diamines described in, for example, JP-A's 63-30845, 63-146040 and 63-43439, polyamines described in JP-A's 63-21647 and 63-26655, polyamines described in JP-A-63-44655, alcohols described in JP-A's 63-43140 and 63-53549, oximes described in JP-A-63-56654 and tertiary amines described in JP-A-63-239447.

As other preservatives, for example, various metals described in JP-A's 57-44148 and 57-53749, salicylic acids described in JP-A-59-180588, alkanolamines described in JP-A-54-3532, polyethyleneimines described in JP-A-56-94349 and aromatic polyhydroxy compounds described in U.S. Pat. No. 3,746,544 may be contained therein if necessary.

The color developer for use in the present invention can contain other compounds known as components for developer.

Appropriate alkali agent and pH buffer are added to the color developer for use in the present invention in order to maintain the pH value within the above range. As the alkali agent and pH buffer, there can be employed carbonates such as sodium carbonate, potassium carbonate, sodium hydrogencarbonate and potassium hydrogencarbonate; alkali hydroxides such as sodium hydroxide and potassium hydroxide; phosphates such as trisodium phosphate and dipotassium phosphate; borates such as potassium borate and sodium tetraborate; and organic acid salts such as dipotassium 5-sulfosalicylate and disodium 4-sulfosalicylate.

The above alkali agent and pH buffer are added to the color developer in an amount of 0.01 to 0.5 mol/L, preferably 0.01 to 0.2 mol/L.

Furthermore, in the color developer, various chelating agents can be used as a precipitation-preventing agent for calcium and magnesium or in order to increase the stability of color developer. Chelating agents preferably consist of organic acid compounds, examples of which include aminopolycarboxylic acids, organophosphonic acids and phosphonocarboxylic acids. Specific examples of such chelating agents include nitrilotriacetic acid, diethylenetriaminepentaacetic acid, ethylenediaminetetraacetic acid, N,N,N-trimethylenesulfonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamine-o-hydroxyphenylacetic acid, 1-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid and 1,2-dihydroxyoxybenzene-3,5-disulfonic acid. These chelating agents may be used in combination if necessary.

The addition amount of chelating agents is preferably in the range of 0.01 to 20 g, more preferably 0.1 to 10 g, per L of color developer. If necessary, an arbitrary development accelerator can be added to the color developer. For attaining the maximum exhibition of development activity, a thioether-type fog accelerator may be added to the color developer. As thioether fogging agents, use is made of thioether compounds described in, for example, JP-B's 37-16088, 37-5987, 38-7826, 44-12380 and 45-9019 and U.S. Pat. No. 3,813,247. Further, use can be made of amine compounds such as ethylenediamine. Among these compounds, 3,6-dithiaoctane-1,8-diol is preferred. When the fogging agent is added to the color developer, the addition amount thereof is in the range of about 1 to 20 mmol/L.

With respect to the quantity of replenisher for the color developer of the present invention, 40 to 4000 milliliters/$m^2$ are satisfactory in continuing the processing. The amount of waste liquid can be minimized by minimizing the quantity of replenisher. Therefore, it is preferred to minimize the quantity of replenisher, as long as the developer is stable. (Hereinafter, milliliters will be referred to as "mL".) The quantity of replenisher is preferably less than 2000 mL/$m^2$, more preferably less than 1600 mL/$m^2$.

In the present invention, the color development is followed by a desilvering conducted with the use of a processing solution having bleaching capacity. In the desilvering, use is made of a bleaching solution, a bleach-fix solution or both. Such a processing solution contains a bleaching agent. As the bleaching agent, there can be employed, for example, compounds of polyvalent metals such as iron (III), peracids, quinones and nitro compounds. Examples of representative preferably employed bleaching agents include bleaching agents of organic complex salts of iron (III), for example, iron complex salts of ethylenediaminetetraacetic acid, diethylenetriaminepentaacetic acid, cyclohexanediaminetetraacetic acid, methyliminodiacetic acid, glycol ether diaminetetraacetic acid and 1,3-propylenediaminetetraacetic acid described in JP-A-4-121739, right lower column of page 4 to left upper column of page 5; carbamoyl bleaching agents described in JP-A-4-73647; heterocyclic bleaching agents described in JP-A-4-174432; ferric complex salt of N-(2-carboxyphenyl)iminodiacetic acid and related bleaching agents described in EP No. 520457; ferric complex salt of ethylenediamine-N-2-carboxyphenyl-N,N',N'-triacetic acid and related bleaching agents described in EP No. 530828A1; bleaching agents described in EP No. 501479; bleaching agents described in JP-A-4-127145; and ferric salt of aminopolycarboxylic acid and related salts described in JP-A-5-303186 and JP-A-3-144446 (page 11).

Organic aminocarboxylic acid iron (III) complex salts are especially useful in both the bleaching solution and the bleach-fix solution. Although the pH value of the bleaching solution and bleach-fix solution containing the above organic aminocarboxylic acid iron (III) complex salts generally ranges from 4.0 to 8.0, the processing can be conducted at lower pH values in order to expedite the processing.

In the present invention, in addition to the bleaching agent, a re-halogenating agent as described in page 12 of JP-A-3-144446 mentioned above, a pH buffer, known additives, an aminopolycarboxylic acid, an organophosphonic acid, etc. can be used in the processing bath having bleaching capacity.

Further, in the present invention, various bleaching accelerators can be added to the bleaching solution or prebath thereof (conditioner). As these bleaching accelerators, there can be employed, for example, mercapto group- or disulfido group-having compounds described in U.S. Pat. No. 3,893,858, DE U.S. Pat. No. 1,290,821, GB No. 1,138,842, JP-A-53-95630 and Research Disclosure No. 17129 (July, 1978); thiazolidine derivatives described in JP-A-50-140129; thiourea derivatives described in U.S. Pat. No. 3,706,561; iodides described in JP-A-58-16235; polyoxyethylene oxides described in DE U.S. Pat. No. 2,748,430; and polyamine compounds described in JP-B-45-8836. Still further, compounds described in U.S. Pat. No. 4,552,834 are also preferred. These bleaching accelerators may be incorporated in the lightsensitive material. These bleaching accelerators are especially effective in the bleach-fix of photographic color lightsensitive materials. Mercapto compounds described in GB No. 1,138,842 and JP-A-2-190856 are most preferred.

For preventing bleach stains, it is preferred that, in addition to the above compounds, an organic acid be added to the processing solution having bleaching capacity (bleaching solution or bleach-fix solution). Especially preferred organic acids are compounds whose acid dissociation constant (pKa) ranges from 2 to 5. Preferred examples of such compounds include acetic acid, lactic acid, malonic acid, maleic acid, glutaric acid, succinic acid, propionic acid and hydroxyacetic acid.

It is preferred that these organic acids be contained in an amount of 0.005 to 3 mol per L of processing solution having bleaching capacity. Although it is preferred that the bleaching be performed immediately after the color development, in the reversal processing, a conditioner (may be a bleaching accelerator solution) is generally used therebetween.

The conditioner can contain chelating agents of aminopolycarboxylic acids such as ethylenediaminetetraacetic acid, diethylenetriaminepentaacetic acid, 1,3-diaminopropanetetraacetic acid and cyclohexanediaminetetraacetic acid; sulfites such as sodium sulfite and ammonium sulfite; and various bleaching accelerators such as thioglycerol, aminoethanethiol and sulfoethanethiol. Further, for the purpose of scum prevention, it is preferred to add, to the conditioner, sorbitan esters of fatty acids substituted with ethylene oxide, described in U.S. Pat. No. 4,839,262; and polyoxyethylene compounds described in U.S. Pat. No. 4,059,446 and Research Disclosure, vol. 191, 19104 (1980). These compounds, although can be used in an amount of 0.1 to 20 g per L of conditioner, are preferably added in an amount of 1 to 5 g per L of conditioner.

Further, the conditioner can contain an image stabilizing agent as described later. The pH value of the conditioner is generally in the range of 3 to 11, preferably 4 to 9, and more preferably 4.5 to 7. The time of processing with the use of the conditioner is preferably in the range of 20 sec to 15 min, more preferably 20 sec to 100 sec, and most preferably 20 sec to 60 sec. The quantity of replenisher for the conditioner is preferably in the range of 30 to 3000 mL, more preferably 50 to 1500 mL, per $m^2$ of lightsensitive material. The temperature of processing with the use of the conditioner is preferably in the range of 20 to 50° C., more preferably 30 to 40° C.

In the present invention, the desilvering may be followed by washing and processing with the use of a stabilizer bath in this sequence. Alternatively, the desilvering may be followed by processing with the use of a stabilizer directly without performing washing. The amount of water used in the washing step can be set within a wide range, depending on the properties of lightsensitive material (for example, attributed to the employed material of coupler, etc.), use, temperature of washing water, number of washing tanks (number of stages), replenishing method such as counter current or fair current and other various conditions. Of these, the relationship between the number of washing tanks and the amount of water in the multistage counter current system can be determined by the method described in Journal of the Society of Motion Picture and Television Engineers, vol. 64, pp. 248 to 253 (May, 1955). Although the amount of washing water can be extremely reduced, the multistage counter current system described in this literature encounters a problem such that the residence time of water in the tank is increased to thereby invite growth of bacteria with the result that resultant suspended matter sticks to the lightsensitive material. In the processing of the present invention, the method of JP-A-62-288838 in which the amount of calcium ions and magnesium ions is decreased can very effectively utilized as a countermeasure to the above problem. Also, there can preferably be employed isothiazolone compounds and cyabenzazoles as described in JP-A-57-8542; chlorinated bactericides such as sodium chloroisocyanurate; other benzotriazoles; and bactericides described in "Bokin Bokabizai No Kagaku (Chemistry of Antibacterial Mildewproofing Agents)" written by Hiroshi Horiguchi and published by Sankyo Shuppan (1986), "Biseibutsu No Mekkin, Sakkin, Bokabigijutsu (Microorganism Sterilization, Pasteurization & Mildewproofing Technology)" edited by the Hygienic Technology Association and published by Kogyo Gijutsu Kai (Industrial Technology Association) (1982) and "Bokin Bokabizai Jiten (Antibacterial Mildewproofing Agent Cyclopedia)" edited by the Antibacterial Mildewproofing Society of Japan (1986).

As the stabilizer of the present invention, although stabilizers containing formaldehyde are generally employed, there can also be used other known stabilizers and processing methods as described in, for example, U.S. Pat. Nos. 4,786,583 and 4,859,574 and JP-A's 3-33847, 4-270344, 4-313753, 4-359249, 5-34889, 5-165178, 57-8543, 58-14834 and 60-220345.

A compound capable of stabilizing a dye image (hereinafter referred to as "image stabilizing agent") is contained in the stabilizer or conditioner of the present invention. The image stabilizing agent can be, for example, any of formaldehyde, benzaldehydes such as m-hydroxybenzaldehyde, formaldehyde bisulfite adducts, hexamethylenetetramine and derivatives thereof, hexahydrotriazine and derivatives thereof, dimethylolurea, and N-methylol compounds such as N-methylolpyrazole. In the present invention, it is preferred that the free formaldehyde concentration of the solution be in the range of 0 to 0.01%, especially 0 to 0.005%, from the viewpoint that the effect of the invention can be enhanced. As the image stabilizing agent for attaining the above free formaldehyde concentration, there can be preferably employed m-hydroxybenzaldehyde, hexamethylenetetramine, N-methylolazoles of JP-A-4-270344 such as N-methylolpyrazole, and azolylmethylamines of JP-A-4-313753 such as N,N'-bis(1,2,4-triazol-1-ylmethyl) piperazine.

The content of the above image stabilizing agent is preferably in the range of 0.001 to 0.1 mol, more preferably 0.001 to 0.05 mol, per L of stabilizer. For preventing the occurrence of water spots at the drying of processed lightsensitive material, it is preferred that the stabilizer of the present invention contain various surfactants. Examples of such surfactants include polyethylene glycol nonionic surfactants, polyhydric alcohol nonionic surfactants, alkylbenzenesulfonate anionic surfactants, higher alcohol sulfate anionic surfactants, alkylnaphthalenesulfonate anionic surfactants, quaternary ammonium salt cationic surfactants, amine salt cationic surfactants, amino salt amphoteric surfactants and betaine amphoteric surfactants. The use of nonionic surfactants is preferred. Nonionic surfactants such as alkylpolyethylene oxides, alkylphenoxypolyethylene oxides and alkylphenoxypolyhydroxypropylene oxides are especially preferred.

It is preferred that a chelating agent as heavy metal scavenger be added to the stabilizer of the present invention, from the viewpoint that the stability of the stabilizer is enhanced and that any contamination can be reduced. As the chelating agent, there can be employed the same compounds as added to the above developer and bleaching solution. Further, an antibacterial/mildewproofing agent is preferably added to the stabilizer of the present invention in order to prevent the occurrence of bacteria and mildew. Commercially available antibacterial/mildewproofing agents can be used.

The pH value of each of the stabilizer and washing water according to the present invention is in the range of 4 to 9, preferably 5 to 8. The processing temperature and processing time, although can be set in variation depending on, for example, the properties and usage of lightsensitive material, are generally in the range of 15 to 45° C. and 20 sec to 10 min, preferably 25 to 40° C. and 30 sec to 2 min, respectively. The anti-contamination effect of the stabilizer of the present invention is striking when the desilvering is directly followed by processing with the use of the stabilizer without performing washing.

The quantity of replenisher for the stabilizer of the present invention is preferably in the range of 200 to 2000 mL per $m^2$ of lightsensitive material. The overflow solution resulting from the above washing and/or stabilizer replenishing can be recycled to desilvering and other steps.

Ion exchange or ultrafiltration may be effected for reducing the amount of washing water consumed. Ultrafiltration is preferred. The processing solutions of the present invention are applied at 10 to 50° C. Although generally the temperature of 33 to 38° C. is standard, the temperature can be raised so as to expedite the processing and reduce the processing time. Contrarily, the temperature can be lowered so as to accomplish the improvement of image quality and the improvement of processing solution stability.

EXAMPLE

The present invention will be described in greater detail below by way of its examples. However, the present invention is in no way limited to these examples.

Example 1

Preparation of Sample 101

A color lightsensitive material consisting of a support of undercoated cellulose triacetate film and, superimposed thereon, two layers of the following compositions was prepared and designated sample 101. The figures are for the addition amount per $m^2$. With respect to the silver halide, the indicated addition amount is in terms of silver quantity. With respect to the sensitizing dyes added to the silver halide, the indicated addition amount is per mol of silver halide.

1st Layer: Green-sensitive Emulsion Layer

| | |
|---|---|
| Silver iodobromide monodispersed tabular grains (equiv. sphere av. grain diam. = 0.3 μm, var. coefficient = 18%, and AgI content = 4.0 mol %) | Ag qty. 1.00 g |
| Sensitizing dye S-1 | 0.20 g |
| Sensitizing dye S-2 | 0.15 g |
| Gelatin | 3.50 g |
| Comparative coupler a | 0.30 g |
| High boiling org. solvent oil-1 | 0.15 g |
| Surfactant W-5 | 25 mg. |

2nd Layer: Protective Layer

| | |
|---|---|
| Gelatin | 2.00 g |
| Polymethyl methacrylate (av. particle diam. 2.0 μm) | 0.10 g |
| Surfactant W-1 | 0.15 g |
| Gelatin hardener H-1 | 0.17 g. |

oil-1

Tricresyl phospate

W-1

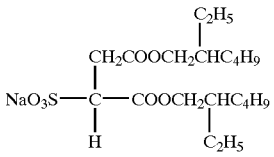

W-5

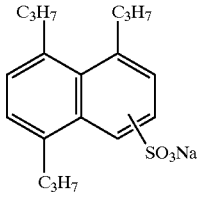

H-1

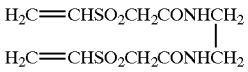

S-1

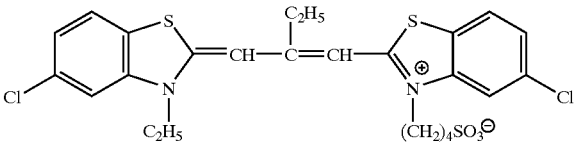

S-2

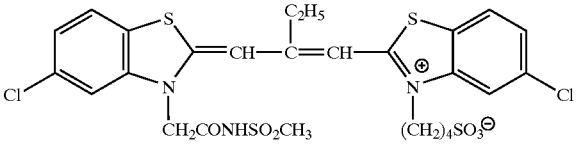

Preparation of Samples 102 to 137

Samples 102 to 137 were prepared in the same manner as Sample 101, except that the magenta coupler in 1st layer of Sample 101 was replaced by an equimolar amount of other couplers as shown in Table 1 below.

TABLE 1

| | 1st layer | | | Yellow stain (after irradiation) | |
|---|---|---|---|---|---|
| Sample No. | Magenta coupler | Oil/ coupler ratio (wt) | Stain-preventing agent (Addition amount with respect to coupler; mol %) | Immediately after processing | One week after processing under 60° C., 70% |
| 101 (Comp.) | a | 0.3 | none | 0.04 | 0.08 |
| 102 (Comp.) | a | 0.3 | 1 (25) | 0.04 | 0.08 |
| 103 (Comp.) | b | 0.3 | none | 0.20 | 0.23 |
| 104 (Comp.) | b | 0.3 | 1 (25) | 0.20 | 0.23 |
| 105 (Comp.) | b | 0.3 | 7 (25) | 0.20 | 0.23 |
| 106 (Comp.) | 2 | 0.3 | none | 0.04 | 0.21 |
| 107 (Comp.) | 2 | 0.3 | 1 (25) | 0.02 | 0.10 |
| 108 (Inv.) | 2 | 0.3 | 7 (25) | 0.02 | 0.09 |
| 109 (Comp.) | 2 | 0.3 | 13 (25) | 0.02 | 0.08 |
| 110 (Comp.) | 2 | 0.3 | 14 (25) | 0.02 | 0.09 |
| 111 (Inv.) | 2 | 0.3 | 22 (25) | 0.02 | 0.10 |
| 112 (Inv.) | 2 | 0.3 | 36 (25) | 0.01 | 0.06 |

TABLE 1-continued

| | 1st layer | | | Yellow stain (after irradiation) | |
|---|---|---|---|---|---|
| Sample No. | Magenta coupler | Oil/ coupler ratio (wt) | Stain-preventing agent (Addition amount with respect to coupler; mol %) | Immediately after processing | One week after processing under 60° C., 70% |
| 113 (Inv.) | 2 | 0.3 | 40 (25) | 0.01 | 0.06 |
| 114 (Inv.) | 2 | 0.3 | 54 (25) | 0.01 | 0.05 |
| 115 (Inv.) | 2 | 0.3 | 58 (25) | 0.01 | 0.06 |
| 116 (Comp.) | 14 | 0.3 | none | 0.05 | 0.22 |
| 117 (Comp.) | 14 | 0.3 | 1 (25) | 0.02 | 0.08 |
| 118 (Inv.) | 14 | 0.3 | 35 (25) | 0.02 | 0.09 |
| 119 (Inv.) | 14 | 0.3 | 36 (25) | 0.01 | 0.04 |
| 120 (Comp.) | 38 | 0.3 | none | 0.05 | 0.25 |
| 121 (Inv.) | 38 | 0.3 | 42 (25) | 0.01 | 0.08 |
| 122 (Inv.) | 38 | 0.3 | 43 (25) | 0.01 | 0.08 |
| 123 (Inv.) | 1 | 0.3 | 45 (25) | 0.01 | 0.06 |
| 124 (Inv.) | 3 | 0.3 | 48 (25) | 0.01 | 0.05 |
| 125 (Inv.) | 4 | 0.3 | 54 (25) | 0.01 | 0.06 |
| 126 (Inv.) | 5 | 0.3 | 58 (25) | 0.01 | 0.06 |
| 127 (Inv.) | 6 | 0.3 | 37 (25) | 0.01 | 0.03 |
| 128 (Inv.) | 10 | 0.3 | 38 (25) | 0.01 | 0.04 |
| 129 (Inv.) | 15 | 0.3 | 49 (25) | 0.01 | 0.06 |
| 130 (Inv.) | 16 | 0.3 | 51 (25) | 0.01 | 0.05 |
| 131 (Inv.) | 19 | 0.3 | 31 (25) | 0.01 | 0.06 |
| 132 (Comp.) | 22 | 0.3 | 5 (25) | 0.02 | 0.08 |
| 133 (Inv.) | 24 | 0.3 | 7 (25) | 0.02 | 0.08 |
| 134 (Comp.) | 27 | 0.3 | 15 (25) | 0.02 | 0.06 |
| 135 (Inv.) | 32 | 0.3 | 20 (25) | 0.02 | 0.09 |
| 136 (Inv.) | 7 | 0.3 | 50 (50) | 0.01 | 0.03 |
| 137 (Inv.) | 8 | 0.3 | 36 (50) | 0.01 | 0.03 |

Oil-1 was used as a high-boiling organic solvent in every sample.

Comparative Coupler a

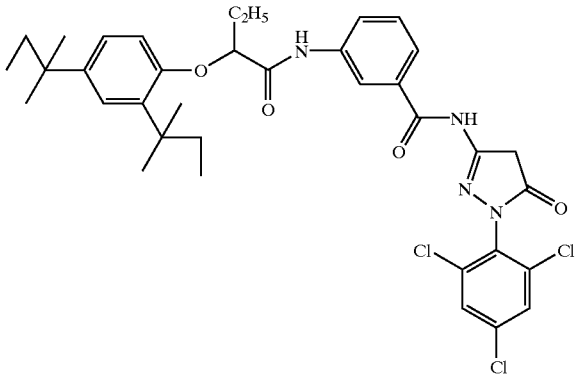

Comparative Coupler b

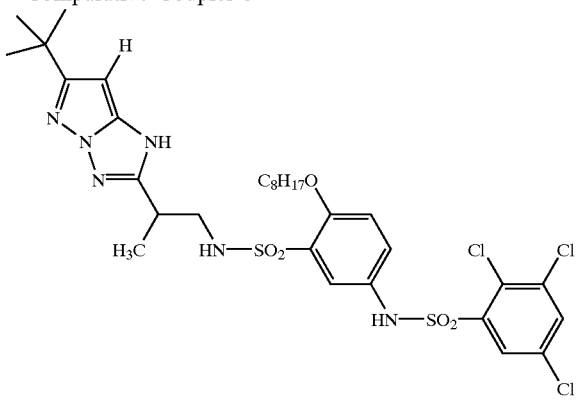

Evaluation of yellow stain: After white light of 500lux was exposed to two sets of the samples, the development processing set forth below was performed. One set of the thus processed samples was left to stand for 1 week under the atmosphere of 60° C., 70%HR, and the other set of the thus processed samples was exposed to fluorescent lamp of 20,000lux for two weeks immediately after the processing to measure yellow stain densities under the two conditions. Evaluation was performed by subtracting the density before the fluorescent lamp exposure from the density after the fluorescent lamp exposure. The smaller the value is, the less the yellow stain generation is.

| Processing Step | Time | Tempera-ture | Tank volume | Replenishment rate |
|---|---|---|---|---|
| 1st development | 6 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 1,500 mL/m$^2$ |
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 38° C. | 8 L | 7,500 mL/m$^2$ |
| Final rinsing | 1 min | 25° C. | 2 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid.pentasodium salt | 1.5 g | 1.5 g |
| Diethylenetriamine pentaacetic acid.pentasodium salt | 2.0 g | 2.0 g |
| Sodium sulfite | 30 g | 30 g |
| Hydroquinone.potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid.pentasodium salt | 3.0 g | the same as tank solution |
| Stannous chloride.dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid.pentasodium salt | 2.0 g | 2.0 g |
| Sodium sulfite | 7.0 g | 7.0 g |
| Trisodium phosphate.dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon amidoethyl)-3-methyl-4 aminoaniline.3/2 sulfuric acid.monohydrate | 11 g | 11 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid.disodium salt dihydrate | 8.0 g | 8.0 g |

-continued

| <Pre-bleaching solution> | <Tank solution> | <Replenisher> |
|---|---|---|
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid.disodium salt.dihydrate | 2.0 g | 4.0 g |
| Ethylenediaminetetraacetic acid.Fe(III).ammonium.dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

<Result>

The obtained results were listed in Table 1.

It is apparent that the sample 101 using the conventional pyrazolone coupler and the sample 103 using a coupler being a structural isomer of the coupler for use in the present invention exhibit high light stain immediately after the processing thereof and after being held in high humidity at high temperature. Irrespective of the addition of stain preventives, any preventive effect cannot be recognized (samples 102, 104 and 105).

On the other hand, the sample 106 using the coupler according to the present invention favorably exhibits low light stain immediately after the processing. However, it is seen that the light stain after holding the sample in high humidity at high temperature is high. Therefore, it is apparent that there is the danger of staining by light irradiation after storing the sample for a prolonged period of time.

By contrast, it is apparent that the samples 108, 111 to 115, 118, 119, 121 to 131, 133, and 135 to 137, in which the preventives defined in the invention exhibit lower light yellow staining than those of the samples 106, 116 and 120 not loaded with such preventives both immediately after the processing thereof and after being held in high humidity at high temperature. It is further apparent that the samples 112 to 115, 118, 119, 123 to 130 and 137 loaded with combinations of preventives of the general formula (TS-III) and couplers of the general formula (MC-II) exhibit lower staining and are hence preferable.

Moreover, the samples of the present invention were also excellent in light fastness and dark heat fastness.

Preparation of sample 201

A multilayer color lightsensitive material consisting of a support of 127 $\mu$m thick undercoated cellulose triacetate film and, superimposed thereon, a given number of layers of the following compositions was prepared and designated sample 201. The figures are for the addition amount per $m^2$. The effects of added compounds are not limited to described uses.

1st Layer: Antihalation Layer

| | |
|---|---|
| Black colloidal silver | 0.25 g |
| Gelatin | 2.40 g |
| Ultraviolet absorbent U-1 | 0.10 g |
| Ultraviolet absorbent U-3 | 0.10 g |
| Ultraviolet absorbent U-4 | 0.10 g |
| High-boiling organic solvent oil-1 | 0.050 g |
| High-boiling organic solvent oil-2 | 0.050 g |
| Dye D-8 | 2.5 mg |
| Fine-crystal solid dispersion of dye E-1 | 0.05 g |

2nd Layer: Interlayer

| | |
|---|---|
| Gelatin | 1.00 g |
| Compound Cpd-A | 0.2 mg |
| Compound Cpd-J | 1.0 mg |
| Compound Cpd-K | 5.0 mg |
| Compound Cpd-M | 0.030 g |
| High-boiling organic solvent oil-3 | 0.010 g |
| High-boiling organic solvent oil-4 | 0.010 g |
| High-boiling organic solvent oil-6 | 2.0 mg |
| High-boiling organic solvent oil-7 | 4.0 mg |
| Dye D-7 | 2.5 mg |

3rd Layer: Interlayer

| | |
|---|---|
| Yellow colloidal silver | silver 0.020 g |
| Gelatin | 0.60 g |
| Compound Cpd-M | 0.030 g |
| High-boiling organic solvent oil-3 | 0.010 g |

4th Layer: Low-speed Red-sensitive Emulsion Layer

| | |
|---|---|
| Emulsion A | silver 0.20 g |
| Emulsion B | silver 0.20 g |
| Emulsion C | silver 0.15 g |
| Gelatin | 0.80 g |
| Coupler C-1 | 0.050 g |
| Coupler C-2 | 0.10 g |
| Coupler C-3 | 0.010 g |
| Coupler C-5 | 6.0 mg |
| Coupler C-6 | 5.0 mg |
| Coupler C-8 | 0.050 g |

-continued

| | |
|---|---|
| Compound Cpd-A | 1.0 mg |
| Compound Cpd-I | 0.020 g |
| Compound Cpd-J | 5.0 mg |
| High-boiling organic solvent oil-1 | 0.10 g |
| Additive P-1 | 0.02 g |

5th Layer: Medium-speed Red-sensitive Emulsion Layer

| | |
|---|---|
| Emulsion C | silver 0.25 g |
| Emulsion D | silver 0.30 g |
| Gelatin | 0.80 g |
| Coupler C-1 | 0.20 g |
| Coupler C-2 | 0.050 g |
| Coupler C-3 | 0.020 g |
| Coupler C-5 | 7.0 mg |
| Coupler C-8 | 0.050 g |
| Ultraviolet absorbent U-1 | 0.010 g |
| High-boiling organic solvent oil-1 | 0.10 g |
| Additive P-1 | 0.020 g |

6th Layer: High-speed Red-sensitive Emulsion Layer

| | |
|---|---|
| Emulsion E | silver 0.25 g |
| Emulsion F | silver 0.25 g |
| Gelatin | 1.40 g |
| Coupler C-1 | 0.10 g |
| Coupler C-3 | 0.60 g |
| Coupler C-8 | 0.20 g |
| Ultraviolet absorbent U-1 | 0.010 g |
| Ultraviolet absorbent U-2 | 0.010 g |
| High-boiling organic solvent oil-1 | 0.10 g |
| Compound Cpd-D | 5.0 mg |
| Compound Cpd-K | 2.0 mg |
| Compound Cpd-F | 0.050 g |
| Additive P-1 | 0.10 g |
| Dye D-9 | 3.0 mg |

7th Layer: Interlayer

| | |
|---|---|
| Gelatin | 0.40 g |
| Additive P-2 | 0.10 g |
| Compound Cpd-I | 0.010 g |
| Dye D-5 | 0.020 g |
| Dye D-9 | 3.0 mg |
| Compound Cpd-M | 0.040 g |
| Compound Cpd-O | 3.0 mg |
| Compound Cpd-P | 2.5 mg |
| High-boiling organic solvent oil-5 | 0.050 g |

8th Layer: Interlayer

| | |
|---|---|
| Yellow colloidal silver | silver 0.010 g |
| Gelatin | 1.50 g |
| Additive P-1 | 0.05 g |
| Ultraviolet absorbent U-1 | 0.010 g |
| Ultraviolet absorbent U-3 | 0.010 g |
| Compound Cpd-A | 0.050 g |
| Compound Cpd-M | 0.050 g |
| High-boiling organic solvent oil-3 | 0.010 g |
| High-boiling organic solvent oil-5 | 0.050 g |

9th Layer: Low-speed Green-sensitive Emulsion Layer

| | |
|---|---|
| Emulsion G | silver 0.30 g |
| Emulsion H | silver 0.35 g |
| Emulsion I | silver 0.30 g |
| Gelatin | 1.50 g |
| Comparative coupler a | 0.25 g |
| Compound Cpd-B | 0.030 g |
| Compound Cpd-D | 5.0 mg |
| Compound Cpd-E | 5.0 mg |
| Compound Cpd-G | 2.5 mg |
| Compound Cpd-F | 0.040 g |
| Compound Cpd-K | 2.0 mg |
| Compound Cpd-L | 0.020 g |
| Ultraviolet absorbent U-6 | 5.0 mg |
| High-boiling organic solvent oil-1 | 0.075 g |
| Additive P-2 | 5.0 mg |

10th Layer: Medium-speed Green-sensitive Emulsion Layer

| | |
|---|---|
| Emulsion I | silver 0.30 g |
| Emulsion J | silver 0.20 g |
| Internally fogged silver bromide emulsion (cubic, average equivalent-sphere grain size 0.11 $\mu$m) | silver 5.0 mg |
| Gelatin | 0.50 g |
| Comparative coupler a | 0.33 g |
| Compound Cpd-B | 0.030 g |
| Compound Cpd-D | 0.020 g |
| Compound Cpd-F | 0.050 g |
| Compound Cpd-G | 2.0 mg |
| High-boiling organic solvent oil-1 | 0.10 g |

11th Layer: High-speed Green-sensitive Emulsion Layer

| | |
|---|---|
| Emulsion K | silver 0.55 g |
| Gelatin | 0.70 g |
| Comparative coupler a | 0.40 g |
| Compound Cpd-B | 0.080 g |
| Compound Cpd-D | 0.020 g |
| Compound Cpd-F | 0.040 g |
| Compound Cpd-K | 5.0 mg |
| High-boiling organic solvent oil-1 | 0.12 g |

12th Layer: Interlayer

| | |
|---|---|
| Gelatin | 0.50 g |
| Compound Cpd-M | 0.05 g |
| High-boiling organic solvent oil-3 | 0.025 g |
| High-boiling organic solvent oil-5 | 0.025 g |

13th Layer: Yellow Filter Layer

| | |
|---|---|
| Yellow colloidal silver | silver 0.015 g |
| Gelatin | 0.60 g |
| Compound Cpd-C | 0.010 g |
| Compound Cpd-M | 0.030 g |
| Compound Cpd-L | 0.010 g |
| High-boiling organic solvent oil-5 | 0.020 g |
| Fine-crystal solid dispersion of dye E-2 | 0.20 g |

14th Layer: Interlayer

| | |
|---|---|
| Gelatin | 0.30 g |

15th Layer: Low-speed Blue-sensitive Emulsion Layer

| | |
|---|---|
| Emulsion L | silver 0.20 g |
| Emulsion M | silver 0.20 g |
| Gelatin | 0.80 g |
| Coupler C-4 | 0.030 g |
| Coupler C-5 | 5.0 mg |
| Coupler C-7 | 0.20 g |
| Compound Cpd-I | 0.010 g |
| Compound Cpd-M | 0.010 g |
| High-boiling organic solvent oil-2 | 0.050 g |

16th Layer: Medium-speed Blue-sensitive Emulsion Layer

| | |
|---|---|
| Emulsion N | silver 0.20 g |
| Emulsion O | silver 0.15 g |
| Internally fogged silver bromide emulsion (cubic, average equivalent-sphere grain size 0.11 $\mu$m) | silver 0.010 g |
| Gelatin | 0.90 g |
| Coupler C-4 | 0.050 g |
| Coupler C-5 | 0.020 g |
| Coupler C-7 | 0.30 g |
| Compound Cpd-N | 2.0 mg |
| High-boiling organic solvent oil-1 | 0.080 g |

17th Layer: High-speed Blue-sensitive Emulsion Layer

| | |
|---|---|
| Emulsion O | silver 0.20 g |
| Emulsion P | silver 0.20 g |
| Gelatin | 1.50 g |
| Coupler C-3 | 5.0 mg |
| Coupler C-4 | 0.10 g |
| Coupler C-5 | 0.020 g |
| Coupler C-7 | 1.15 g |
| High-boiling organic solvent oil-1 | 0.10 g |
| Ultraviolet absorbent U-6 | 0.10 g |
| Compound Cpd-B | 0.20 g |
| Compound Cpd-N | 5.0 mg |
| Compound Cpd-Q | 0.20 g |

18th Layer: 1st Protective Layer

| | |
|---|---|
| Gelatin | 0.60 g |
| Ultraviolet absorbent U-1 | 0.20 g |
| Ultraviolet absorbent U-2 | 0.050 g |
| Ultraviolet absorbent U-5 | 0.20 g |

-continued

| | |
|---|---|
| Compound Cpd-O | 5.0 mg |
| Compound Cpd-A | 0.030 g |
| Compound Cpd-H | 0.20 g |
| Dye D-1 | 8.0 mg |
| Dye D-2 | 5.0 mg |
| Dye D-3 | 5.0 mg |
| High-boiling organic solvent oil-3 | 0.10 g |

19th Layer: 2nd Protective Layer

| | |
|---|---|
| Colloidal silver | silver 0.11 mg |
| Fine-grain silver iodobromide emulsion (average grain size 0.06 μm, AgI content 1 mol %) | silver 0.10 g |
| Gelatin | 0.50 g |

20th Layer: 3rd Protective Layer

| | |
|---|---|
| Gelatin | 0.60 g |
| Polymethylmethacrylate (average grain size 1.5 μm) | 0.10 g |
| 6:4 copolymer of methylmethacrylate and methacrylic acid (average grain size 1.5 μm) | 0.10 g |
| Silicone oil SO-1 | 0.050 g |
| Surfactant W-2 | 3.0 mg |
| Surfactant W-3 | 8.0 mg |
| Surfactant W-1 | 0.040 g |
| Surfactant W-7 | 0.015 g |

In addition to the above compositions, additives F-1 to F-9 were added to all emulsion layers. Also, a gelatin hardener H-1, which is the same compound as in Example 1, and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

The light-sensitive emulsions used in Sample 201 are set forth in Tables 2 and 3.

TABLE 2

Silver iodobromide emulsions used in Sample 101 are as follows:

| Emulsion | Features | Average equivalent sphere diameter (μm) | Coefficient of variation (%) | AgI content (%) |
|---|---|---|---|---|
| A | Monodisperse tetradecahedral grains | 0.15 | 10 | 4.5 |
| B | Monodisperse (100) Tbl grains having A.A. Ratio of 5.0 | 0.27 | 15 | 3.5 |
| C | Monodisperse (111) internally-fogged-type Tbl grains having A.A. Ratio of 10.0 | 0.30 | 15 | 3.8 |
| D | Monodisperse (111) Tbl Grains having A.A. Ratio of 10.0 | 0.35 | 18 | 3.0 |
| E | Monodisperse (111) Tbl Grains having A.A. Ratio of 15.0 | 0.50 | 10 | 1.3 |
| F | Monodisperse (111) Tbl Grains having A.A. Ratio of 20.0 | 0.60 | 15 | 1.8 |
| G | Monodisperse cubic grains | 0.17 | 9 | 3.5 |
| H | Monodisperse (100) Tbl Grains having A.A. Ratio of 6.0 | 0.25 | 12 | 3.5 |
| I | Monodisperse (111) Tbl Grains having A.A. Ratio of 10.0 | 0.35 | 20 | 3.0 |
| J | Monodisperse (111) Tbl Grains having A.A. Ratio of 12.0 | 0.45 | 16 | 3.0 |
| K | Monodisperse (111) Tbl Grains having A.A. Ratio of 20.0 | 0.60 | 15 | 2.0 |
| L | Monodisperse (100) Tbl Grainss having A.A. Ratio of 7.0 | 0.30 | 12 | 3.5 |
| M | Monodisperse (111) Tbl Grains having A.A. Ratio of 8.0 | 0.35 | 10 | 4.5 |
| N | Monodisperse (111) Tbl Grains having A.A. Ratio of 15.0 | 0.50 | 15 | 2.0 |
| O | Monodisperse (111) Tbl Grainss having A.A. Ratio of 20.0 | 0.70 | 9 | 2.0 |
| P | Monodisperse (111) Tbl Grainss having A.A. Ratio of 20.0 | 1.00 | 15 | 1.8 |

Note

1) Tbl Grains = Tabular grains

2) A.A. Ratio = Average aspect ratio

TABLE 3

| Spectral sensitization of Emulsions A to P | | |
|---|---|---|
| Emulsion | Spectral sensitizer added | Addition amount per mol of silver halide (g) |
| A | S-1 | 0.01 |
| | S-2 | 0.25 |
| | S-3 | 0.02 |
| | S-8 | 0.20 |
| | S-13 | 0.015 |
| | S-14 | 0.01 |
| B | S-2 | 0.20 |
| | S-3 | 0.02 |
| | S-8 | 0.20 |
| | S-13 | 0.015 |
| | S-14 | 0.01 |
| C | S-2 | 0.25 |
| | S-3 | 0.04 |
| | S-8 | 0.20 |
| | S-13 | 0.02 |
| | S-14 | 0.10 |
| D | S-2 | 0.20 |
| | S-3 | 0.03 |
| | S-8 | 0.20 |
| | S-13 | 0.01 |
| E | S-2 | 0.20 |
| | S-3 | 0.05 |
| | S-8 | 0.25 |
| | S-13 | 0.01 |
| | S-14 | 0.02 |
| F | S-2 | 0.25 |
| | S-3 | 0.04 |
| | S-8 | 0.15 |
| | S-14 | 0.02 |
| G | S-4 | 0.3 |
| | S-5 | 0.05 |
| | S-12 | 0.1 |

TABLE 3-continued

| Spectral sensitization of Emulsions A to P | | |
|---|---|---|
| Emulsion | Spectral sensitizer added | Addition amount per mol of silver halide (g) |
| H | S-4 | 0.3 |
| | S-5 | 0.05 |
| | S-14 | 0.02 |
| I | S-4 | 0.3 |
| | S-9 | 0.2 |
| | S-12 | 0.1 |
| J | S-4 | 0.35 |
| | S-5 | 0.05 |
| | S-12 | 0.1 |
| K | S-4 | 0.25 |
| | S-9 | 0.10 |
| | S-12 | 0.1 |
| | S-14 | 0.02 |
| L | S-6 | 0.1 |
| | S-10 | 0.2 |
| | S-11 | 0.05 |
| M | S-6 | 0.05 |
| | S-10 | 0.25 |
| | S-11 | 0.05 |
| N | S-10 | 0.4 |
| | S-11 | 0.15 |
| O | S-6 | 0.05 |
| | S-7 | 0.05 |
| | S-10 | 0.3 |
| | S-11 | 0.1 |
| P | S-6 | 0.05 |
| | S-7 | 0.05 |
| | S-10 | 0.2 |
| | S-11 | 0.25 |

Compounds used in each layer of Sample 201 are listed below:

C-1

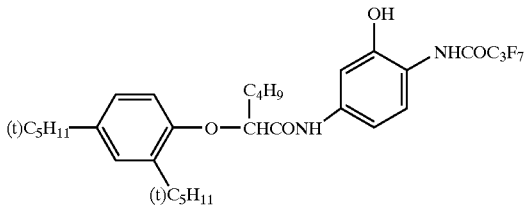

C-2

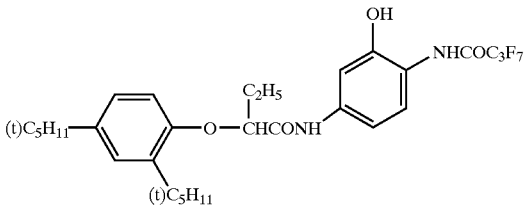

C-3

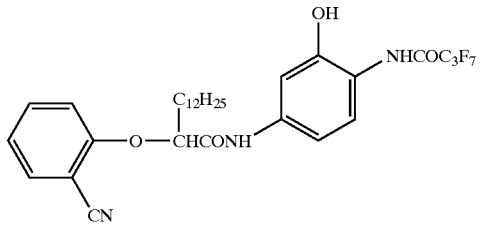

C-4

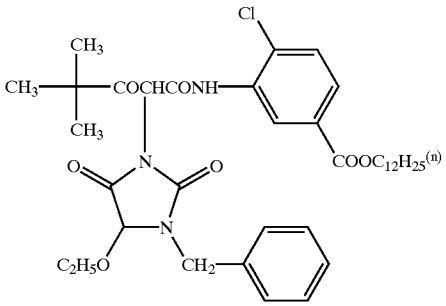

-continued
C-5
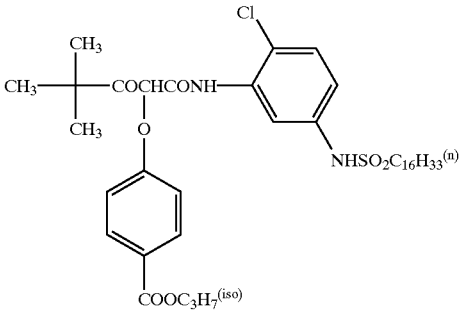
C-6
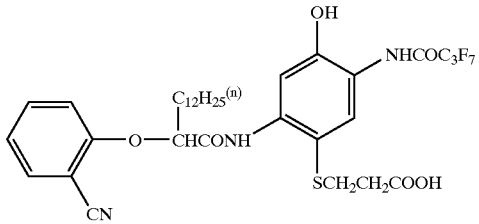
C-7
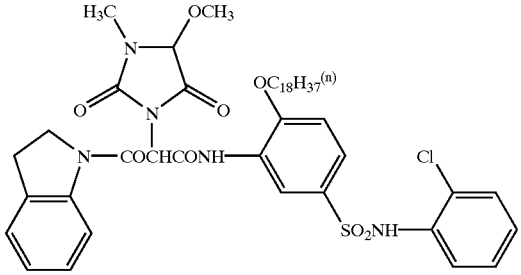
C-8
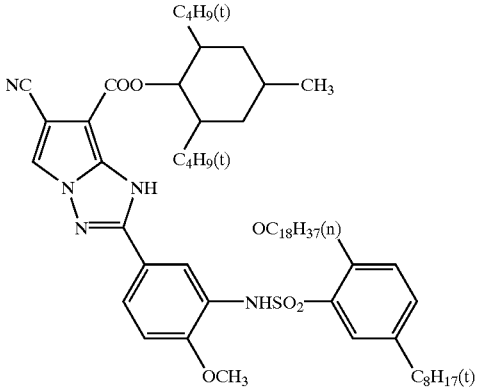
oil-1
Tricresyl phosphate
oil-2
Tricresyl n-hexyl phosphate
oil-3
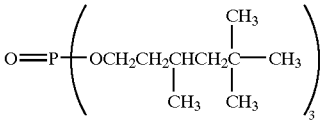
oil-4
Tricyclohexyl phosphate
oil-5
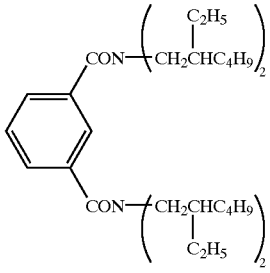
oil-6
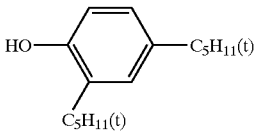
oil-7
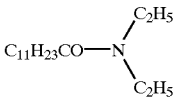
Cpd-A
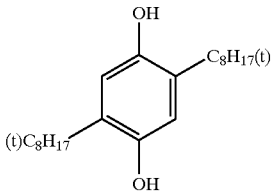
Cpd-B
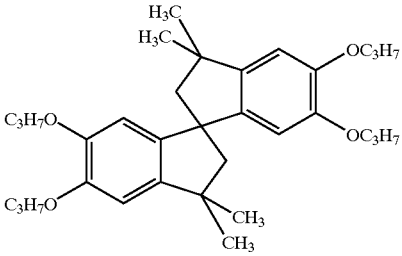
Cpd-C
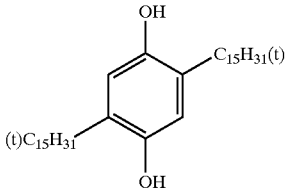

-continued
Cpd-D
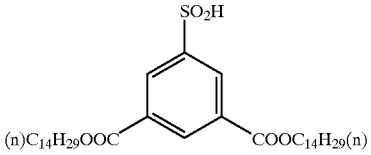
Cpd-E
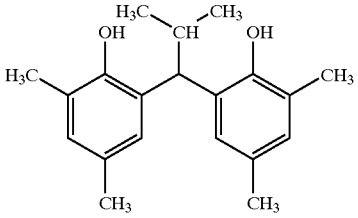
Cpd-F
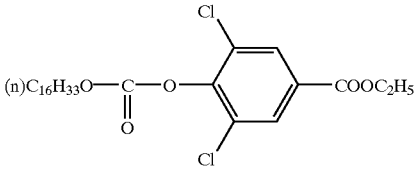
Cpd-G
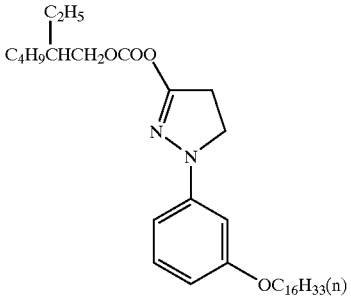
Cpd-H
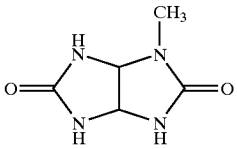
Cpd-I
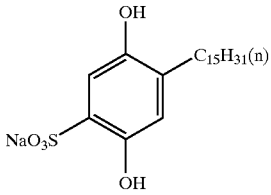
Cpd-J
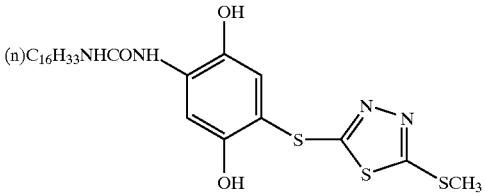
Cpd-K
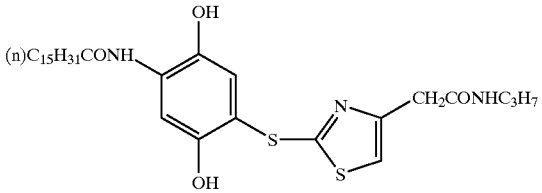
Cpd-L
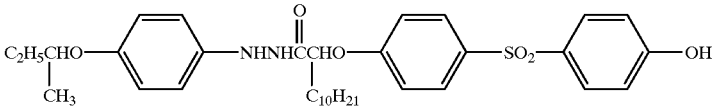
Cpd-M
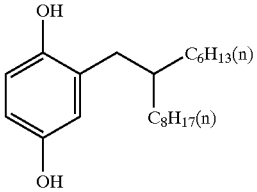
Cpd-N
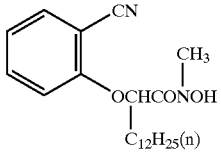
Cpd-O
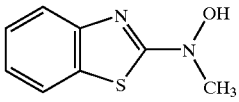
Cpd-P
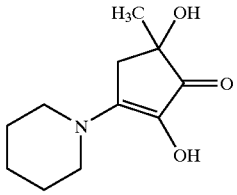

-continued
Cpd-Q
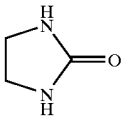
U-1
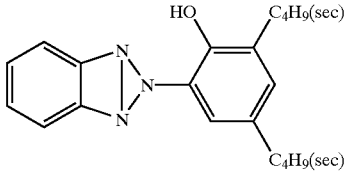
U-2
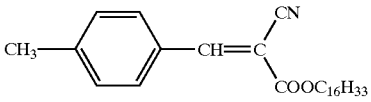
U-3
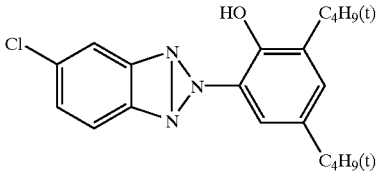
U-4
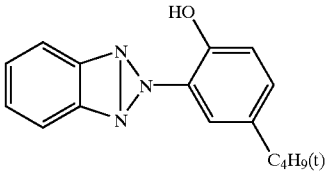
U-5
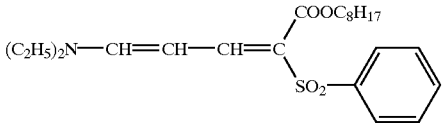
U-6
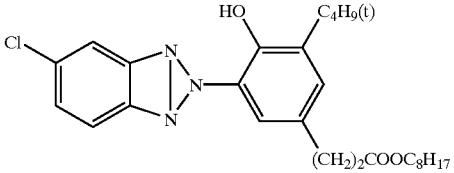
S-1
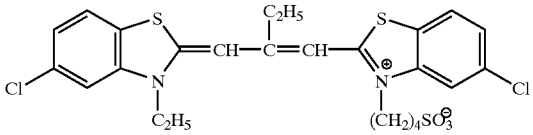
S-2
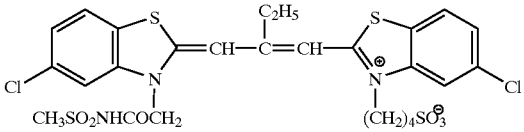
S-3
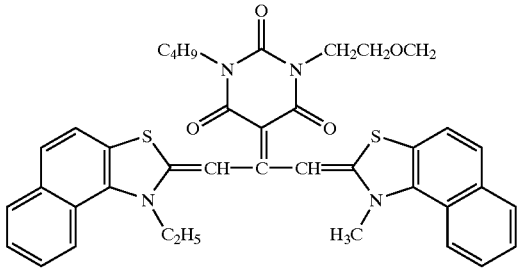
S-4
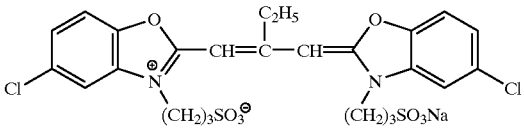
S-5
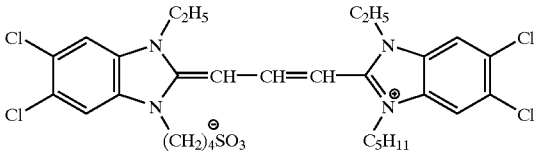
S-6
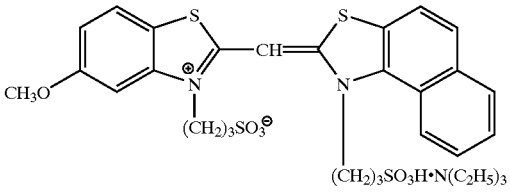
S-7
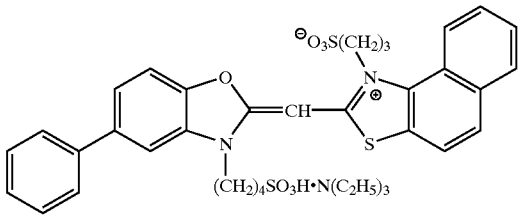
S-8
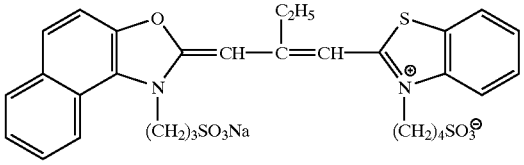
S-9
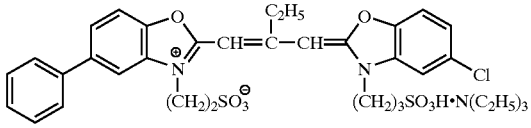

-continued
S-10
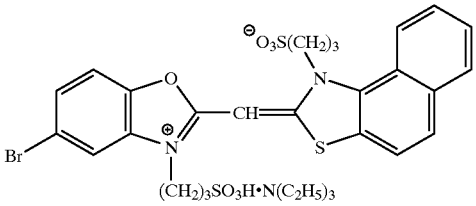
S-11
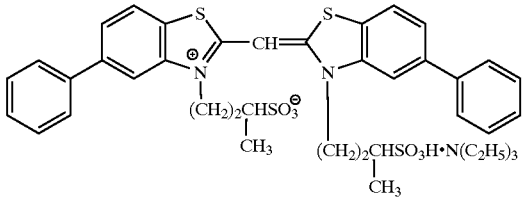
S-12
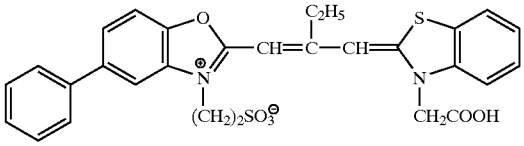
S-13
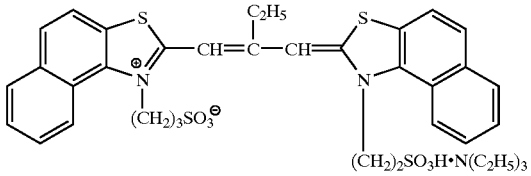
S-14
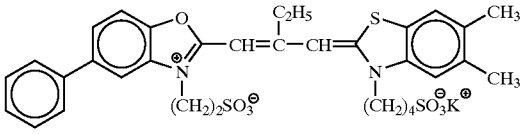
D-1
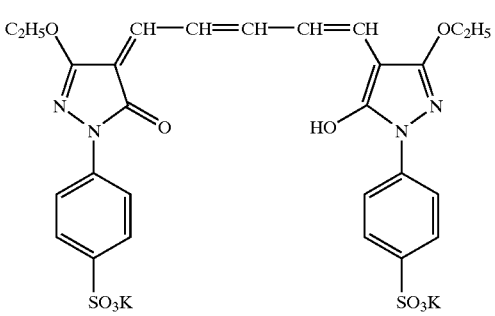
D-2
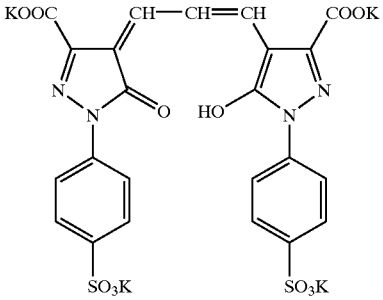
D-3
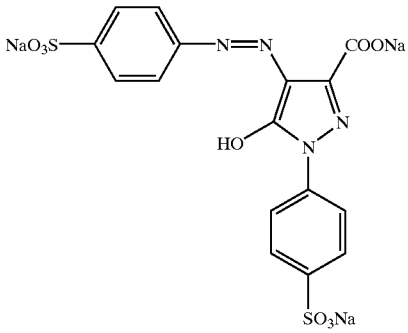
D-4
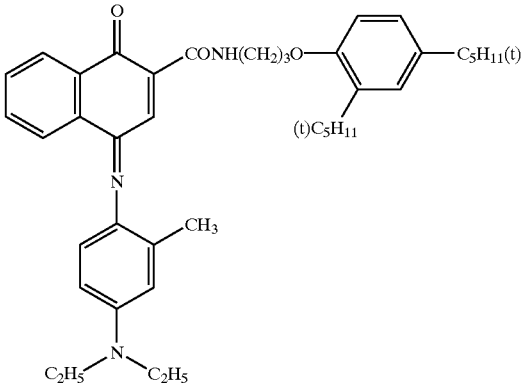
D-5
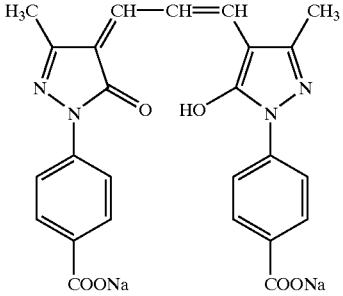

-continued
D-6
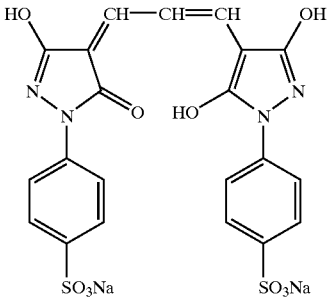
D-7
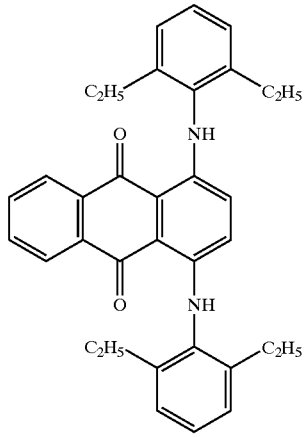
D-8
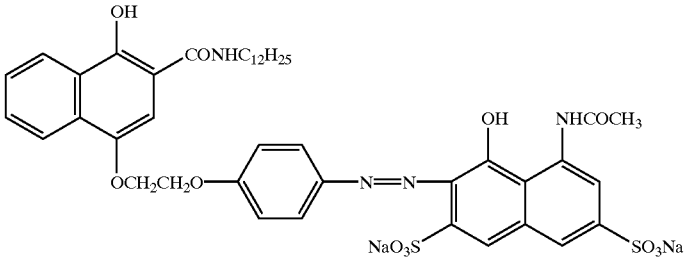
D-9
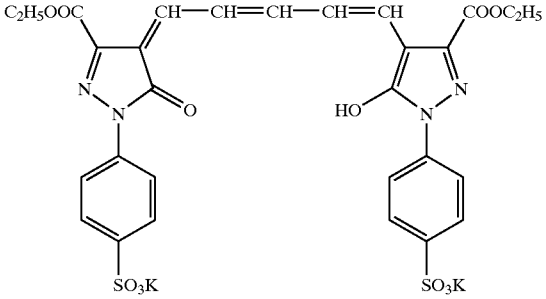
E-1
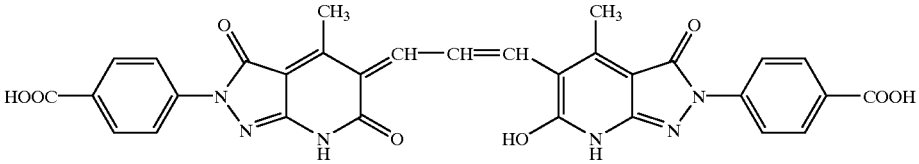
E-2
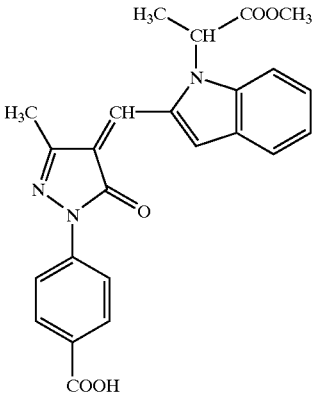
W-1
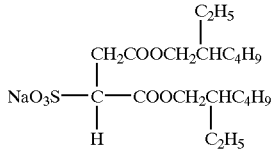

-continued
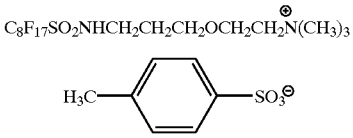
W-2
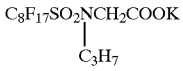
W-3
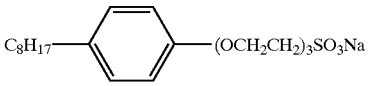
W-4
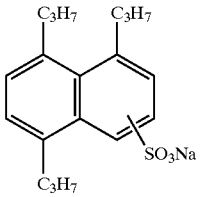
W-5
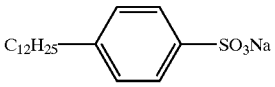
W-6
W-7
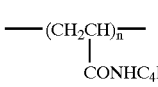
P-1
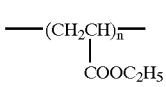
P-2
SO-1
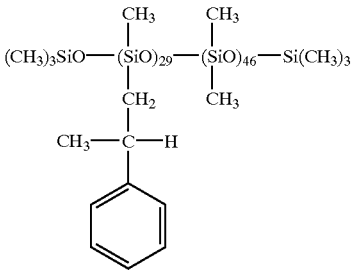
F-1
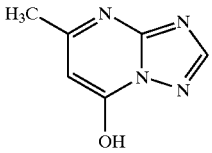
F-2
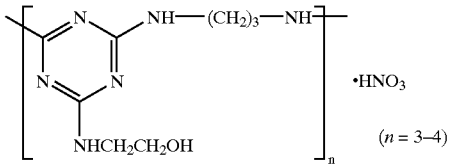
F-3
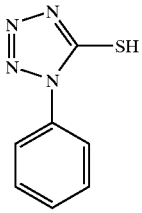
F-4
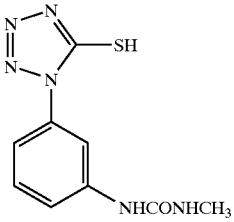
F-5
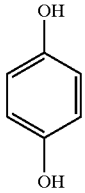
F-6
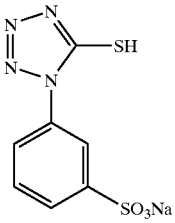
F-7
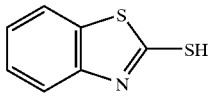

-continued

F-8

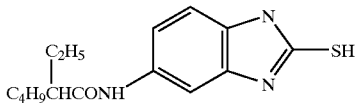

F-9

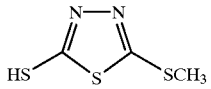

(Preparation of Dispersions of Organic Solid Disperse Dyes)

(Preparation of Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 2 hrs. The beads were filtered out, and water was added to dilute the material to a dye concentration of 3%. After that, the material was heated to 90° C. for 10 hrs for stabilization. The average grain size of the obtained fine dye grains was 0.30 $\mu$m, and the grain size distribution (grain size standard deviation×100/average grain size) was 20%.

(Preparation of Solid Dispersion of Dye E-2)

Water and 270 g of W-4 were added to 1,400 g of a wet cake of E-2 containing 30 wt. % of water, and the resultant material was stirred to form a slurry having an E-2 concentration of 40 wt. %. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 8 hr, thereby obtaining a solid fine-grain dispersion of E-2. This dispersion was diluted to 20 wt. % by ion exchange water to obtain a solid fine-grain dispersion. The average grain size was 0.15 $\mu$m.

(Preparation of Samples 202 to 237)

Samples 202 to 237 were prepared in the same manner as the above sample 201 except that the couplers of the 9th to 11th green-sensitive emulsion layers of the sample 201 were replaced by equimolar amounts of couplers as specified in Table 4.

The thus obtained samples 201 to 237 were evaluated with respect to yellow stain by light irradiation in the same manner as in Example 1. The results are listed in Table 4.

TABLE 4

| | 9th to 11th layers | | | | |
|---|---|---|---|---|---|
| Sample No. | Coupler | Oil/coupler ratio (wt) | Oil used | Stain-preventing agent (addition amount) | Light-stain |
| 201 (Comp.) | a | 0.3 | oil-1 | none | 0.10 |
| 202 (Comp.) | a | 0.3 | oil-1 | 1 (25) | 0.10 |
| 203 (Comp.) | b | 0.3 | oil-1 | none | 0.28 |
| 204 (Comp.) | b | 0.3 | oil-1 | 1 (25) | 0.28 |
| 205 (Comp.) | b | 0.3 | oil-1 | 7 (25) | 0.28 |
| 206 (Comp.) | 2 | 0.3 | oil-1 | none | 0.15 |
| 207 (Comp.) | 2 | 0.3 | oil-1 | 1 (25) | 0.08 |
| 208 (Inv.) | 2 | 0.3 | oil-1 | 7 (25) | 0.08 |
| 209 (Comp.) | 2 | 0.3 | oil-1 | 13 (25) | 0.08 |
| 210 (Comp.) | 2 | 0.3 | oil-2 | 14 (25) | 0.08 |
| 211 (Inv.) | 2 | 0.3 | oil-2 | 22 (25) | 0.08 |
| 212 (Inv.) | 2 | 0.3 | oil-2 | 36 (25) | 0.06 |
| 213 (Inv.) | 2 | 0.3 | oil-3 | 40 (25) | 0.06 |
| 214 (Inv.) | 2 | 0.3 | oil-3 | 54 (25) | 0.06 |
| 215 (Inv.) | 2 | 0.3 | oil-3 | 58 (25) | 0.06 |
| 216 (Comp.) | 14 | 0.3 | oil-3 | none | 0.16 |
| 217 (Comp.) | 14 | 0.3 | oil-4 | 1 (25) | 0.08 |
| 218 (Inv.) | 14 | 0.3 | oil-4 | 35 (25) | 0.06 |
| 219 (Inv.) | 14 | 0.3 | oil-4 | 36 (25) | 0.06 |
| 220 (Comp.) | 38 | 0.3 | oil-4 | none | 0.14 |
| 221 (Inv.) | 38 | 0.3 | oil-5 | 42 (25) | 0.06 |
| 222 (Inv.) | 38 | 0.3 | oil-5 | 43 (25) | 0.06 |
| 223 (Inv.) | 1 | 0.3 | oil-5 | 45 (25) | 0.06 |
| 224 (Inv.) | 3 | 0.3 | oil-6 | 48 (25) | 0.06 |
| 225 (Inv.) | 4 | 0.3 | oil-6 | 54 (25) | 0.06 |
| 226 (Inv.) | 5 | 0.3 | oil-6 | 58 (30) | 0.06 |
| 227 (Inv.) | 6 | 0.3 | oil-7 | 37 (30) | 0.05 |
| 228 (Inv.) | 10 | 0.3 | oil-7 | 38 (50) | 0.04 |
| 229 (Inv.) | 15 | 0.3 | oil-7 | 49 (50) | 0.04 |
| 230 (Inv.) | 16 | 0.3 | oil-1 | 51 (100) | 0.04 |
| 231 (Inv.) | 19 | 0.3 | oil-2 | 31 (25) | 0.06 |
| 232 (Comp.) | 22 | 0.3 | oil-3 | 5 (25) | 0.08 |
| 233 (Inv.) | 24 | 0.3 | oil-4 | 7 (25) | 0.08 |
| 234 (Comp.) | 27 | 0.3 | oil-5 | 15 (25) | 0.08 |
| 235 (Inv.) | 32 | 0.3 | oil-6 | 20 (25) | 0.09 |
| 236 (Inv.) | 7 | 0.3 | oil-7 | 50 (25) | 0.08 |
| 237 (Inv.) | 8 | 0.3 | oil-1 | 36 (25) | 0.08 |

It is apparent from the results of Table 4 that the samples of this invention exert substantially the same effects as those exhibited in Example 1 and that, therefore, the effect of yellow staining prevention is excellent in the multilayer coating film system as well.

The samples of the present invention were excellent in color reproduction and favorably exhibited low dependency on the composition changes in development processing.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic lightsensitive material comprising, on a support, at least one silver halide emulsion layer, wherein the silver halide color photographic lightsensitive material comprises:

at least one magenta coupler represented by a general formula (MC-I):

(MC-I)

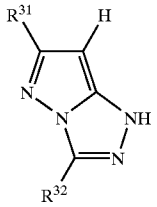

wherein each of $R^{31}$ and $R^{32}$ independently represents a hydrogen atom, a substituted or unsubstituted alkyl group, or a substituted or unsubstituted aryl group; and at least one compound selected from the group consisting of compounds represented by general formula (TS-I-α), general formula (TS-II) and general formula (TS-III):

(TS-I-α)

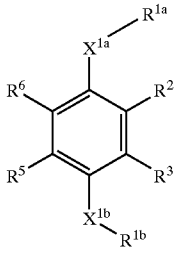

(TS-II)

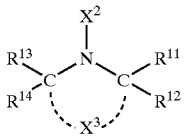

(TS-III)

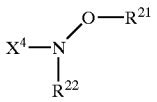

in the formula (TS-I-α), each of $R^{1a}$ and $R^{1b}$ independently represents a hydrogen atom, a substituted or unsubstituted alkyl group, a substituted or unsubstituted alkenyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group, a substituted or unsubstituted arylsulfonyl group, a substituted or unsubstituted phosphino group, a substituted or unsubstituted phosphinyl group or a group of the formula —$SiR^{21}R^{22}R^{23}$, wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; each of —$X^{1a}$— and —$X^{1b}$— independently represents —O—, —S— or —$N(R^{24})$—, wherein $R^{24}$ has the same meaning as $R^{1a}$; and $R^2$, $R^3$, $R^5$ and $R^6$ may be identical with or different from each other, and each thereof represents a hydrogen atom or a substituent, provided that $R^{1a}$ and $R^2$, or $R^{24}$ and $R^6$, or $R^{1a}$ and $R^{24}$, may be bonded with each other to thereby form a 5 to 7 membered ring, provided that $R^2$ and $R^3$, or $R^3$ and $R^{1b}$, or $R^{1b}$ and $R^5$, or $R^5$ and $R^6$, may be bonded with each other to thereby form a 5 to 7 membered ring, spiro ring or bicyclo ring, and provided that $R^{1a}$, $R^2$, $R^3$, $R^{1b}$, $R^5$, $R^6$ and $R^{24}$ are not simultaneously hydrogen atoms;

in the formula (TS-II), each of $R^{11}$, $R^{12}$, $R^{13}$ and $R^{14}$ independently represents a hydrogen atom, a substituted or unsubstituted alkyl group or a substituted or unsubstituted alkenyl group, provided that $R^{11}$ and $R^{12}$, or $R^{13}$ and $R^{14}$, may be bonded with each other to thereby form a 5 to 7 membered ring; $X^2$ represents a hydrogen atom, a substituted or unsubstituted alkyl group, a substituted or unsubstituted alkenyl group, a substituted or unsubstituted alkoxy group, a substituted or unsubstituted alkenyloxy group, a substituted or unsubstituted alkyloxycarbonyl group, a substituted or unsubstituted alkenyloxycarbonyl group, a substituted or unsubstituted aryloxycarbonyl group, a substituted or unsubstituted acyl group, a substituted or unsubstituted acyloxy group, a substituted or unsubstituted alkyloxycarbonyloxy group, a substituted or unsubstituted alkenyloxycarbonyloxy group, a substituted or unsubstituted aryloxycarbonyloxy group, a substituted or unsubstituted alkylsulfonyl, a substituted or unsubstituted alkenylsulfonyl group, a substituted or unsubstituted arylsulfonyl group, a substituted or unsubstituted alkylsulfinyl group, a substituted or unsubstituted alkenylsulfinyl group, a substituted or unsubstituted arylsulfinyl group, a substituted or unsubstituted sulfamoyl group, a substituted or unsubstituted carbamoyl group, a hydroxyl group or an oxyl group; and $X^3$ represents a group of nonmetallic atoms required to form a 5 to 7 membered ring; and in the formula (TS-III), each of $R^{21}$ and $R^{22}$ independently has the same meaning as $R^{1a}$; $X^4$ represents a substituted or unsubstituted alkyl group or a substituted or unsubstituted aryl group, a substituted or unsubstituted heterocyclic group, —CO—$R^{123}$, —CO—O—$R^{123}$ or —CO—$NR^{124}(R^{125})$, wherein $R^{123}$ represents a substituted or unsubstituted alkyl group, a substituted or unsubstituted aryl group or a substituted or unsubstituted heterocyclic group, and each of $R^{124}$ and $R^{125}$ independently represents a hydrogen atom, a substituted or unsubstituted alkyl group, a substituted or unsubstituted aryl group, a substituted or unsubstituted amino group, or a substituted or unsubstituted alkoxy group.

2. The silver halide color photographic lightsensitive material according to claim 1, wherein said at least one compound is represented by the formula (TS-II), and wherein $R^{11}$, $R^{12}$, $R^{13}$, $R^{14}$, $X^2$ and $X^3$ have the same meaning as defined in claim 1.

3. The silver halide color photographic lightsensitive material according to claim 1, wherein said at least one compound is represented by the formula (TS-III), and wherein $R^{21}$, $R^{22}$ and $X^4$ have the same meaning as defined in claim 1.

4. A silver halide color photographic lightsensitive material comprising, on a support, at least one silver halide emulsion layer, wherein the silver halide color photographic lightsensitive material comprises:

at least one magenta coupler represented by a general formula (MC-II):

(MC-II)

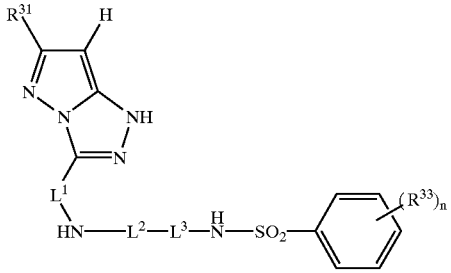

wherein $R^{31}$ represents a hydrogen atom, a substituted or unsubstituted alkyl group, or a substituted or unsubstituted aryl group; $L^1$ represents a substituted or unsubstituted alkylene group or a substituted or unsubstituted arylene group; $L^2$ represents $—SO_2—$ or —CO—; and $L^3$ represents a substituted or unsubstituted alkylene group or a substituted or unsubstituted arylene group; $R^{33}$ represents a substituent; n is an integer of 0 to 5, provided that when is 2 or greater, a plurality of $R^{33}$ groups may be identical with or different from each other; and at least one compound selected from the group consisting of compounds represented by general formula (TS-I), general formula (TS-II) and general formula (TS-III):

(TS-I)

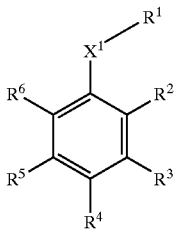

-continued (TS-II)

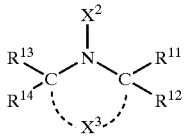

(TS-III)

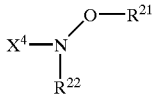

in the formula (TS-I), $R^1$ represents a hydrogen atom, a substituted or unsubstituted alkyl group, a substituted or unsubstituted alkenyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group, a substituted or unsubstituted arylsulfonyl group, a substituted or unsubstituted phosphino group, a substituted or unsubstituted phosphinyl group or a group of the formula $—SiR^{21}R^{22}R^{23}$, wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; $—X^1—$ represents —O—, —S— or $—N(R^{24})—$, wherein $R^{24}$ has the same meaning as $R^1$; and $R^2$, $R^3$, $R^4$, $R^5$ and $R^6$ may be identical with or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5 to 7 membered ring, provided that $R^2$ and $R^3$, or $R^3$ and $R^4$, or $R^4$ and $R^5$, or $R^5$ and $R^6$, may be bonded with each other to thereby form a 5 to 7 membered ring, spiro ring or bicyclo ring, and provided that $R^1$, $R^2$, $R^3$, $R^4$, $R^5$, $R^6$ and $R^{24}$ are not simultaneously hydrogen atoms;

in the formula (TS-II), each of $R^{11}$, $R^{12}$, $R^{13}$ and $R^{14}$ independently represents a hydrogen atom, a substituted or unsubstituted alkyl group or a substituted or unsubstituted alkenyl group, provided that $R^{11}$ and $R^{12}$, or $R^{13}$ and $R^{14}$, may be bonded with each other to thereby form a 5 to 7 membered ring; $X^2$ represents a hydrogen atom, a substituted or unsubstituted alkyl group, a substituted or unsubstituted alkenyl group, a substituted or unsubstituted alkoxy group, a substituted or unsubstituted alkenyloxy group, a substituted or unsubstituted alkyloxycarbonyl group, a substituted or unsubstituted alkenyloxycarbonyl group, a substituted or unsubstituted aryloxycarbonyl group, a substituted or unsubstituted acyl group, a substituted or unsubstituted acyloxy group, a substituted or unsubstituted alkyloxycarbonyloxy group, a substituted or unsubstituted alkenyloxycarbonyloxy group, a substituted or unsubstituted aryloxycarbonyloxy group, a substituted or unsubstituted alkylsulfonyl, a substituted or unsubstituted alkenylsulfonyl group, a substituted or unsubstituted arylsulfonyl group, a substituted or unsubstituted alkylsulfinyl group, a substituted or unsubstituted alkenylsulfinyl group, a substituted or unsubstituted arylsulfinyl group, a substituted or unsubstituted sulfamoyl group, a substituted or unsubstituted carbamoyl group, a hydroxyl group or an oxyl group; and $X^3$ represents a group of nonmetallic atoms required to form a 5 to 7 membered ring; and in the formula (TS-III), each of $R^{21}$ and $R^{22}$ independently has the same meaning as $R^1$; $X^4$ represents a substituted or unsubstituted alkyl group or a substituted or unsubstituted aryl group, a substituted or unsubstituted heterocyclic group, —CO—$R^{123}$, —CO—O—$R^{123}$ or —CO—$NR^{124}(R^{125})$, wherein $R^{123}$ represents a substituted or unsubstituted alkyl group, a substituted or unsubstituted aryl group or a substituted or unsubstituted heterocyclic group, and each of $R^{124}$ and $R^{125}$ independently represents a hydrogen atom, a substituted or unsubstituted alkyl group, a substituted or unsubstituted aryl group, a substituted or unsubstituted amino group, or a substituted or unsubstituted alkoxy group.

5. The silver halide color photographic lightsensitive material according to claim 1, wherein said at least one magenta coupler is represented by general formula (MC-II):

(MC-II)

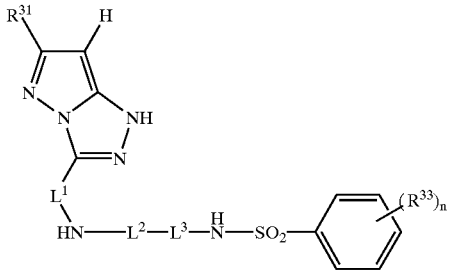

wherein $R^{31}$ represents a hydrogen atom, a substituted or unsubstituted alkyl group, or a substituted or unsubstituted aryl group; $L^1$ represents a substituted or unsubstituted alkylene group having 1 to 30 carbon atoms or a substituted or unsubstituted arylene group having 6 to 10 carbon atoms; $L^2$ represents —$SO_2$— or —CO—; $L^3$ represents a substituted or unsubstituted alkylene group or a substituted or unsubstituted arylene group; $R^{33}$ represents a substituent having Hammett's constant σp value of 0 or more; n is an integer of 0 to 5, provided that when is 2 or greater, a plurality of $R^{33}$ groups may be identical with or different from each other.

6. The silver halide color photographic lightsensitive material according to claim 5, wherein $R^{31}$ represents a substituted or unsubstituted alkyl group having 1 to 6 carbon atoms; $L^1$ represents a substituted or unsubstituted alkylene group having 1 to 30 carbon atoms; $L^2$ represents —$SO_2$— or —CO—; $L^3$ represents a substituted or unsubstituted arylene group having 6 to 16 carbon atoms; $R^{33}$ represents a halogen atom, an alkoxycarbonyl group, an aryloxycarbonyl group or a carbamoyl group; n is an integer of 0 to 5, provided that when n is 2 or greater, a plurality of $R^{33}$ groups may be identical with or different from each other.

7. The silver halide color photographic lightsensitive material according to claim 5, wherein $R^{31}$ represents an unsubstituted tertiary alkyl group having 3 to 6 carbon atoms; $L^1$ represents an unsubstituted alkylene group having 1 to 3 carbon atoms; $L^2$ represents —$SO_2$— or —CO—; $L^3$ represents a substituted or unsubstituted arylene group having 6 to 16 carbon atoms; $R^{33}$ represents a halogen atom, a carbamoyl group, an alkoxycarbonyl group or an aryloxycarbonyl group; and n is 1 or 2.

8. The silver halide color photographic lightsensitive material according to claim 5, wherein $R^{31}$ represents a t-butyl group; $L^1$ represents an unsubstituted alkylene group having 1 to 3 carbon atoms; $L^2$ represents —$SO_2$—; $L^3$ represents an arylene group substituted with an alkoxy group having 6 to 26 carbon atoms; $R^{33}$ represents a carbamoyl group or an alkoxycarbonyl group; and n is 1 or 2.

9. A method of forming a color image, comprising sequentially subjecting the silver halide color photographic lightsensitive material according to claim 1 to black and white development, reversal processing and color development using a color developer having a pH value of 11.5 or higher, wherein the color developer is replenished in a quantity of less than 1.6 L per $m^2$ of the lightsensitive material.

10. A method of reducing stain caused by light irradiation after the elapse of a prolonged period of time after processing of a silver halide color photographic lightsensitive material containing a magenta coupler represented by a general formula (MC-I):

(MC-I)

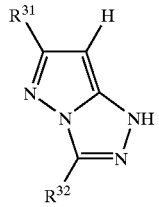

wherein $R^{31}$ and $R^{32}$ have the same meaning as defined in formula (MC-I) of claim 1, respectively, wherein the method comprises loading the silver halide color photographic lightsensitive material with at least one compound selected from the group consisting of compounds represented by general formula (TS-I), general formula (TS-II) and general formula (TS-III):

(TS-I)

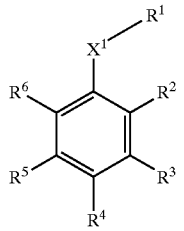

(TS-II)

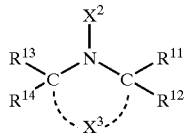

(TS-III)

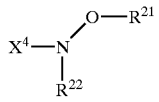

in the formula (TS-I), $R^1$ represents a hydrogen atom, a substituted or unsubstituted alkyl group, a substituted or unsubstituted alkenyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group, a substituted or unsubstituted arylsulfonyl group, a substituted or unsubstituted phosphino group, a substituted or unsubstituted phosphinyl group or a group of the formula —$SiR^{21}R^{22}R^{23}$, wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; —$X^1$— represents —O—, —S— or —$N(R^{24})$—, wherein $R^{24}$ has the same meaning as $R^1$; and $R^2$, $R^3$, $R^4$, $R^5$ and $R^6$ may be identical with or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5 to 7 membered ring, provided that $R^2$ and $R^3$, or $R^3$ and $R^4$, or $R^4$ and $R^5$, or $R^5$ and $R^6$, may be bonded with each other to thereby form a 5 to 7 membered ring, spiro ring or bicyclo ring, and provided that $R^1$, $R^2$, $R^3$, $R^4$, $R^5$, $R^6$ and $R^{24}$ are not simultaneously hydrogen atoms;

in the formula (TS-II), each of $R^{11}$, $R^{12}$, $R^{13}$ and $R^{14}$ independently represents a hydrogen atom, a substituted or unsubstituted alkyl group or a substituted or unsubstituted alkenyl group, provided that $R^{11}$ and $R^{12}$, or $R^{13}$ and $R^{14}$, may be bonded with each other to thereby form a 5 to 7 membered ring; $X^2$ represents a hydrogen atom, a substituted or unsubstituted alkyl group, a substituted or unsubstituted alkenyl group, a substituted or unsubstituted alkoxy group, a substituted or unsubstituted alkenyloxy group, a substituted or unsubstituted alkyloxycarbonyl group, a substituted or unsubstituted alkenyloxycarbonyl group, a substituted or unsubstituted aryloxycarbonyl group, a substituted or unsubstituted acyl group, a substituted or unsubstituted acyloxy group, a substituted or unsubstituted alkyloxycarbonyloxy group, a substituted or unsubstituted alkenyloxycarbonyloxy group, a substituted or unsubstituted aryloxycarbonyloxy group, a substituted or unsubstituted alkylsulfonyl, a substituted or unsubstituted alkenylsulfonyl group, a substituted or unsubstituted arylsulfonyl group, a substituted or unsubstituted alkylsulfinyl group, a substituted or unsubstituted alkenylsulfinyl group, a substituted or unsubstituted arylsulfinyl group, a substituted or unsubstituted sulfamoyl group, a substituted or unsubstituted carbamoyl group, a hydroxyl group or an oxyl group; and $X^3$ represents a group of nonmetallic atoms required to form a 5 to 7 membered ring; and in the formula (TS-III), each of $R^{21}$ and $R^{22}$ independently has the same meaning as $R^1$; $X^4$ represents a substituted or unsubstituted alkyl group or a substituted or unsubstituted aryl group, a substituted or unsubstituted heterocyclic group, —CO—$R^{123}$, —CO—O—$R^{123}$ or —CO—$NR^{124}(R^{125})$, wherein $R^{123}$ represents a substituted or unsubstituted alkyl group, a substituted or unsubstituted aryl group or a substituted or unsubstituted heterocyclic group, and each of $R^{124}$ and $R^{125}$ independently represents a hydrogen atom, a substituted or unsubstituted alkyl group, a substituted or unsubstituted aryl group, a substituted or unsubstituted amino group, or a substituted or unsubstituted alkoxy group.

11. The silver halide color photographic lightsensitive material according to claim 7, wherein in the formula (MC-II), $R^{31}$ represents an unsubstituted tertiary alkyl group having 3 to 6 carbon atoms; $L^1$ represents an unsubstituted alkylene group having 1 to 3 carbon atoms; $L^2$ represents —$SO_2$— or —CO—; $L^3$ represents a substituted or unsubstituted arylene group having 6 to 16 carbon atoms; $R^{33}$ represents a halogen atom, a carbamoyl group, an alkoxycarbonyl group or an aryloxycarbonyl group; and n is 1 or 2; and said at least one compound is selected from the compounds represented by a general formula (TS-I):

(TS-I)

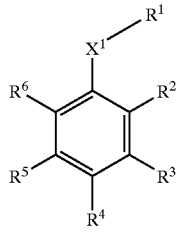

wherein $R^1$ represents a hydrogen atom, a substituted or unsubstituted alkyl group, a substituted or unsubstituted alkenyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group, a substituted or unsubstituted arylsulfonyl group, a substituted or unsubstituted phosphino group, a substituted or unsubstituted phosphinyl group or a group of the formula —$SiR^{21}R^{22}R^{23}$, wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; —$X^1$— represents —O—, —S— or —$N(R^{24})$—, wherein $R^{24}$ has the same meaning as $R^1$; and $R^2$, $R^3$, $R^4$, $R^5$ and $R^6$ may be identical with or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5 to 7 membered ring, provided that $R^2$ and $R^3$, or $R^3$ and $R^4$, or $R^4$ and $R^5$, or $R^5$ and $R^6$, may be bonded with each other to thereby form a 5 to 7 membered ring, spiro ring or bicyclo ring, and provided that $R^1$, $R^2$, $R^3$, $R^4$, $R^5$, $R^6$ and $R^{24}$ are not simultaneously hydrogen atoms.

12. The silver halide color photographic lightsensitive material of claim 1, wherein in the formula (TS-I-α), each of $R^{1a}$ and $R^{1b}$ independently represents a hydrogen atom, a substituted or unsubstituted alkyl group selected from the group consisting of a cycloalkyl group and a bicycloalkyl group, a substituted or unsubstituted alkenyl group selected from the group consisting of a cycloalkenyl group and a bicycloalkenyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group selected from the group consisting of a cycloalkylsulfonyl group and a bicycloalkylsulfonyl group, a substituted or unsubstituted arylsulfonyl group, a substituted or unsubstituted phosphino group, a substituted or unsubstituted phosphinyl group or a group of the formula —$SiR^{21}R^{22}R^{23}$, wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; each of —$X^{1a}$— and —$X^{1b}$— independently represents —O—, —S— or —$N(R^{24})$—, wherein $R^{24}$ has the same meaning as $R^{1a}$; and $R^2$, $R^3$, $R^5$ and $R^6$ may be identical with or different from each other, and each thereof represents a hydrogen atom or a substituent, provided that $R^{1a}$ and $R^2$, or $R^{24}$ and $R^6$, or $R^{1a}$ and $R^{24}$, may be bonded with each other to thereby form a 5 to 7 membered ring, provided that $R^2$ and $R^3$, or $R^3$ and $R^{1b}$, or $R^{1b}$ and $R^5$, or $R^5$ and $R^6$, may be bonded with each other to thereby form a 5 to 7 membered ring, spiro ring or bicyclo ring, and provided that $R^{1a}$, $R^2$, $R^3$, $R^{1b}$, $R^5$, $R^6$ and $R^{24}$ are not simultaneously hydrogen atoms; and in the formula (TS-II), each of $R^{11}$, $R^{12}$, $R^{13}$ and $R^{14}$ independently represents a hydrogen atom, a substituted or unsubstituted alkyl group selected from the group consisting of a cycloalkyl group and a bicycloalkyl group or a substituted or unsubstituted alkenyl group selected from the group consisting of a cycloalkenyl group and a bicycloalkenyl group, provided that $R^{11}$ and $R^{12}$, or $R^{13}$ and $R^{14}$, may be bonded with each other to thereby form a 5 to 7 membered ring; $X^2$ represents a hydrogen atom, a substituted or unsubstituted alkyl group selected from the group consisting of a cycloalkyl group and a bicycloalkyl group, a substituted or unsubstituted alkenyl group selected from the group consisting of a cycloalkenyl group and a bicycloalkenyl group, a substituted or unsubstituted cycloalkyloxy group, a substituted or unsubstituted alkenyloxy group, a substituted or unsubstituted alkyloxycarbonyl group, a substituted or unsubstituted alkenyloxycarbonyl group, a substituted or unsubstituted aryloxycarbonyl group, a substituted or unsubstituted acyl group, a substituted or unsubstituted acyloxy group, a substituted or unsubstituted alkyloxycarbonyloxy group, a substituted or unsubstituted alkenyloxycarbonyloxy group, a substituted or unsubstituted aryloxycarbonyloxy group, a substituted or unsubstituted alkylsulfonyl, a substituted or unsubstituted alkenylsulfonyl group, a substituted or unsubstituted arylsulfonyl group, a substituted or unsubstituted alkylsulfinyl group, a substituted or unsubstituted alkenylsulfinyl group, a substituted or unsubstituted arylsulfinyl group, a substituted or unsubstituted sulfamoyl group, a substituted or unsubstituted carbamoyl group, a hydroxyl group or an oxyl group; and $X^3$ represents a group of nonmetallic atoms required to form a 5 to 7 membered ring.

13. The silver halide color photographic lightsensitive material of claim 4, wherein in the formula (TS-I), $R^1$ represents a hydrogen atom, a substituted or unsubstituted alkyl group selected from the group consisting of a cycloalkyl group and a bicycloalkyl group, a substituted or unsubstituted alkenyl group selected from the group consisting of a cycloalkenyl group and a bicycloalkenyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group selected from the group consisting of a cycloalkylsulfonyl group and a bicycloalkylsulfonyl group, a substituted or unsubstituted arylsulfonyl group, a substituted or unsubstituted phosphino group, a substituted or unsubstituted phosphinyl group or a group of the formula —$SiR^{21}R^{22}R^{23}$, wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; —$X^1$— represents —O—, —S— or —$N(R^{24})$—, wherein $R^{24}$ has the same meaning as $R^1$; and $R^2$, $R^3$, $R^4$, $R^5$ and $R^6$ may be identical with or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5 to 7 membered ring, provided that $R^2$ and $R^3$, or $R^3$ and $R^4$, or $R^4$ and $R^5$, or $R^5$ and $R^6$, may be bonded with each other to thereby form a 5 to 7 membered ring, spiro ring or bicyclo ring, and provided that $R^1$, $R^2$, $R^3$, $R^4$, $R^5$, $R^6$ and $R^{24}$ are not simultaneously hydrogen atoms; and in the formula (TS-II), each of $R^{11}$, $R^{12}$, $R^{13}$ and $R^{14}$ independently represents a hydrogen atom, a substituted or unsubstituted alkyl group selected from the group consisting of a cycloalkyl group and a bicycloalkyl group or a substituted or unsubstituted alkenyl group selected from the group consisting of a cycloalkenyl group and a bicycloalkenyl group, provided that $R^{11}$ and $R^{12}$, or $R^{13}$ and $R^{14}$, may be bonded with each other to thereby form a 5 to 7 membered ring; $X^2$ represents a hydrogen atom, a substituted or unsubstituted alkyl group selected from the group consisting of a cycloalkyl group and a bicycloalkyl group, a substituted or unsubstituted alkenyl group selected from the group consisting of a cycloalkenyl group and a bicycloalkenyl group, a substituted or unsubstituted cycloalkyloxy group, a substituted or unsubstituted alkenyloxy group, a substituted or unsubstituted alkyloxycarbonyl group, a substituted or unsubstituted alkenyloxycarbonyl group, a substituted or unsubstituted aryloxycarbonyl group, a substituted or unsubstituted acyl group, a substituted or unsubstituted acyloxy group, a substituted or unsubstituted alkyloxycarbonyloxy group, a substituted or unsubstituted alkenyloxycarbonyloxy group, a substituted or unsubstituted aryloxycarbonyloxy group, a substituted or unsubstituted alkylsulfonyl, a substituted or unsubstituted alkenylsulfonyl group, a substituted or unsubstituted arylsulfonyl group, a substituted or unsubstituted alkylsulfinyl group, a substituted or unsubstituted alkenylsulfinyl group, a substituted or unsubstituted arylsulfinyl group, a substituted or unsubstituted sulfamoyl group, a substituted or unsubstituted carbamoyl group, a hydroxyl group or an oxyl group; and $X^3$ represents a group of nonmetallic atoms required to form a 5 to 7 membered ring.

14. The method of reducing stain of claim 10, wherein in the formula (TS-I), $R^1$ represents a hydrogen atom, a substituted or unsubstituted alkyl group selected from the group consisting of a cycloalkyl group and a bicycloalkyl group, a substituted or unsubstituted alkenyl group selected from the group consisting of a cycloalkenyl group and a bicycloalkenyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group selected from the group consisting of a cycloalkylsulfonyl group and a bicycloalkylsulfonyl group, a substituted or unsubstituted arylsulfonyl group, a substituted or unsubstituted phosphino group, a substituted or unsubstituted phosphinyl group or a group of the formula —$SiR^{21}R^{22}R^{23}$, wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; —$X^1$— represents —O—, —S— or —$N(R^{24})$—, wherein $R^{24}$ has the same meaning as $R^1$; and $R^2$, $R^3$, $R^4$, $R^5$ and $R^6$ may be identical with or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5 to 7 membered ring, provided that $R^2$ and $R^3$, or $R^3$ and $R^4$, or $R^4$ and $R^5$, or $R^5$ and $R^6$, may be bonded with each other to thereby form a 5 to 7 membered ring, spiro ring or bicyclo ring, and provided that $R^1$, $R^2$, $R^3$, $R^4$, $R^5$, $R^6$ and $R^{24}$ are not simultaneously hydrogen atoms; and in the formula (TS-II), each of $R^{11}$, $R^{12}$, $R^{13}$ and $R^{14}$ independently represents a hydrogen atom, a substituted or unsubstituted alkyl group selected from the group consisting of a cycloalkyl group and a bicycloalkyl group or a substituted or unsubstituted alkenyl group selected from the group consisting of a cycloalkenyl group and a bicycloalkenyl group, provided that $R^{11}$ , and $R^{12}$, or $R^{13}$ and $R^{14}$, may be bonded with each other to thereby form a 5 to 7 membered ring; $X^2$ represents a hydrogen atom, a substituted or unsubstituted alkyl group selected from the group consisting of a cycloalkyl group and a bicycloalkyl group, a substituted or unsubstituted alkenyl group selected from the group consisting of a cycloalkenyl group and a bicycloalkenyl group, a substituted or unsubstituted cycloalkyloxy group, a substituted or unsubstituted alkenyloxy group, a substituted or unsubstituted alkyloxycarbonyl group, a substituted or unsubstituted alkenyloxycarbonyl group, a substituted or unsubstituted aryloxycarbonyl group, a substituted or unsubstituted acyl group, a substituted or unsubstituted acyloxy group, a substituted or unsubstituted alkyloxycarbonyloxy group, a substituted or unsubstituted alkenyloxycarbonyloxy group, a substituted or unsubstituted aryloxycarbonyloxy group, a substituted or unsubstituted alkylsulfonyl, a substituted or unsubstituted alkenylsulfonyl group, a substituted or unsubstituted arylsulfonyl group, a substituted or unsubstituted alkylsulfinyl group, a substituted or unsubstituted alkenylsulfinyl group, a substituted or unsubstituted arylsulfinyl group, a substituted or unsubstituted sulfamoyl group, a substituted or unsubstituted carbamoyl group, a hydroxyl group or an oxyl group; and $X^3$ represents a group of nonmetallic atoms required to form a 5 to 7 membered ring.

15. The silver halide color photographic lightsensitive material according to claim 11, wherein $R^1$ represents a hydrogen atom, a substituted or unsubstituted alkyl group selected from the group consisting of a cycloalkyl group and a bicycloalkyl group, a substituted or unsubstituted alkenyl group selected from the group consisting of a cycloalkenyl group and a bicycloalkenyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted alkylsulfonyl group selected from the group consisting of a cycloalkylsulfonyl group and a bicycloalkylsulfonyl group, a substituted or unsubstituted arylsulfonyl group, a substituted or unsubstituted phosphino group, a substituted or unsubstituted phosphinyl group or a group of the formula —$SiR^{21}R^{22}R^{23}$, wherein each of $R^{21}$, $R^{22}$ and $R^{23}$ independently represents a substituted or unsubstituted alkyl group, a substituted or unsubstituted aryl group, a substituted or unsubstituted alkoxy group, a substituted or unsubstituted alkenyloxy group or a substituted or unsubstituted aryloxy group; —$X^1$— represents —O—, —S— or —$N(R^{24})$—, wherein $R^{24}$ has the same meaning as $R^1$; and $R^2$, $R^3$, $R^4$, $R^5$ and $R^6$ may be identical with or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5 to 7 membered ring, provided that $R^2$ and $R^3$, or $R^3$ and $R^4$, or $R^4$ and $R^5$, or $R^5$ and $R^6$, may be bonded with each other to thereby form a 5 to 7 membered ring, spiro ring or bicyclo ring, and provided that $R^1$, $R^2$, $R^3$ $R^4$, $R^5$, $R^6$ and $R^{24}$ are not simultaneously hydrogen atoms.

* * * * *